US008835373B2

(12) United States Patent
Miravet Celades et al.

(10) Patent No.: US 8,835,373 B2
(45) Date of Patent: Sep. 16, 2014

(54) FLUID FABRIC ENHANCER COMPOSITIONS

(75) Inventors: Juan Felipe Miravet Celades, Castellon (ES); Beatriu Escuder Gil, Sant Mateu-Castellon (ES); Vincent Josep Nebot-Carda, Castellon (ES); Johan Smets, Lubbeek (BE); Pieter Jan Maria Saveyn, Heusden (BE); Susana Fernandez Prieto, Benicarlo (ES)

(73) Assignee: The Procter & Gamble Company, Cincinnati, OH (US)

( * ) Notice: Subject to any disclaimer, the term of this patent is extended or adjusted under 35 U.S.C. 154(b) by 113 days.

(21) Appl. No.: 13/612,918

(22) Filed: Sep. 13, 2012

(65) Prior Publication Data

US 2013/0065813 A1 Mar. 14, 2013

Related U.S. Application Data

(60) Provisional application No. 61/533,980, filed on Sep. 13, 2011.

(51) Int. Cl.

| | |
|---|---|
| ***C11D 3/20*** | (2006.01) |
| ***C11D 3/30*** | (2006.01) |
| ***C11D 3/50*** | (2006.01) |
| ***C11D 3/00*** | (2006.01) |
| ***C11D 17/00*** | (2006.01) |
| ***C11D 3/32*** | (2006.01) |
| ***C11D 7/32*** | (2006.01) |

(52) U.S. Cl.

CPC ..... *C11D 3/32* (2013.01); *C11D 3/0015* (2013.01); *C11D 17/003* (2013.01); *C11D 3/323* (2013.01); *C11D 17/0026* (2013.01); *C11D 7/3263* (2013.01); *C11D 7/3272* (2013.01)

USPC ..... 510/296; 510/101; 510/336; 510/337; 510/349; 510/322; 510/501; 510/504; 510/505

(58) Field of Classification Search

CPC ..... C11D 1/00; C11D 3/001; C11D 3/2013; C11D 3/2075; C11D 3/30; C11D 3/32; C11D 3/505; C11D 17/043

USPC ..... 510/101, 296, 336, 337, 349, 322, 439, 510/501, 505, 504

See application file for complete search history.

(56) References Cited

U.S. PATENT DOCUMENTS

| | | | | |
|---|---|---|---|---|
| 4,373,702 | A | 2/1983 | Jayaraman et al. | |
| 4,487,634 | A | 12/1984 | Turbak et al. | |
| 4,540,721 | A | 9/1985 | Staller | |
| 4,863,565 | A | 9/1989 | Johnson et al. | |
| 4,973,422 | A | 11/1990 | Schmidt | |
| 5,207,826 | A | 5/1993 | Westland et al. | |
| 5,296,622 | A | 3/1994 | Uphues et al. | |
| 5,574,179 | A | 11/1996 | Wahl et al. | |
| 5,759,990 | A | 6/1998 | Wahl et al. | |
| 6,024,943 | A | 2/2000 | Ness et al. | |
| 6,042,792 | A | 3/2000 | Shefer et al. | |
| 6,051,540 | A | 4/2000 | Shefer et al. | |
| 6,413,920 | B1 | 7/2002 | Bettiol et al. | |
| 6,494,920 | B1 | 12/2002 | Weuthen et al. | |
| 6,531,444 | B1 | 3/2003 | Shefer et al. | |
| 6,551,986 | B1 | 4/2003 | Littig et al. | |
| 6,642,200 | B1 | 11/2003 | Zhang et al. | |
| 6,787,512 | B1 | 9/2004 | Verrall et al. | |
| 6,967,027 | B1 | 11/2005 | Heux et al. | |
| 8,168,579 | B2 * | 5/2012 | Fernandez Prieto et al. | 510/303 |
| 8,207,107 | B2 * | 6/2012 | Fernandez Prieto et al. | 510/501 |
| 8,222,197 | B2 * | 7/2012 | Fernandez Prieto et al. | 510/303 |
| 8,236,748 | B2 * | 8/2012 | Fernandez Prieto et al. | 510/501 |
| 8,309,507 | B2 * | 11/2012 | Fernandez Prieto et al. | 510/303 |
| 2003/0216274 | A1 | 11/2003 | Del Duca et al. | |
| 2004/0038851 | A1 | 2/2004 | Aubay et al. | |
| 2004/0065208 | A1 | 4/2004 | Hart et al. | |
| 2004/0087476 | A1 * | 5/2004 | Dykstra et al. | 512/2 |
| 2004/0091445 | A1 * | 5/2004 | Dykstra et al. | 424/70.17 |
| 2004/0092414 | A1 | 5/2004 | Clapp et al. | |
| 2004/0110648 | A1 | 6/2004 | Jordan, IV et al. | |
| 2004/0204337 | A1 | 10/2004 | Corona, III et al. | |
| 2004/0229769 | A1 | 11/2004 | Smith et al. | |
| 2005/0003980 | A1 | 1/2005 | Baker et al. | |
| 2005/0020476 | A1 | 1/2005 | Wahl et al. | |
| 2006/0252168 | A1 * | 11/2006 | Rhee et al. | 438/28 |
| 2006/0252668 | A1 | 11/2006 | Frankenbach et al. | |
| 2007/0027108 | A1 | 2/2007 | Yang et al. | |
| 2007/0275866 | A1 * | 11/2007 | Dykstra | 510/101 |
| 2008/0242584 | A1 * | 10/2008 | Wahl et al. | 510/517 |
| 2010/0325812 | A1 * | 12/2010 | Panandiker et al. | 8/137 |
| 2011/0152146 | A1 * | 6/2011 | Denutte et al. | 510/119 |
| 2011/0152163 | A1 * | 6/2011 | Labeque et al. | 510/406 |
| 2011/0189413 | A1 | 8/2011 | Denome et al. | |
| 2013/0061883 | A1 | 3/2013 | Celades et al. | |

FOREIGN PATENT DOCUMENTS

| | | | |
|---|---|---|---|
| DE | 10157755 | A1 | 6/2003 |
| EP | 1 841 851 | B1 | 6/2009 |
| EP | 2 365 053 | A1 | 9/2011 |
| WO | WO 2005/073358 | A1 | 8/2005 |
| WO | WO 2006/007899 | A1 | 1/2006 |
| WO | WO 2006/007911 | A1 | 1/2006 |
| WO | WO 2009/150017 | A1 | 12/2009 |
| WO | WO 2010/012590 | A1 | 2/2010 |

OTHER PUBLICATIONS

R. G. Weiss and P. Terech (eds.); Molecular Gels: Materials with Self-Assembled Fibrillar Networks; 2006 Springer; Printed in the Netherlands; p. 243.

Estroff, Lara A, et al.; "Water Gelation by Small Organic Molecules"; Chemical Reviews; American Chemical Society; US; vol. 104; No. 3; Jan. 1, 2004; pp. 1201-1217; XP003016413; ISSN: 0009-2665; DOI: 10.1021/CR0302049; derivative 31; p. 1214-p. 1215.

International Search Report; International Application No. PCT/US2012/054971; date of mailing Dec. 5, 2012; 14 pages.

* cited by examiner

*Primary Examiner* — Gregory R Delcotto

(74) *Attorney, Agent, or Firm* — James F. McBride; Steven W. Miller

(57) ABSTRACT

Fluid fabric enhancer compositions comprising external structurants and processes for making and using same are provided. Such fluid fabric enhancer compositions can have a rich impression, stabilize/suspend performance ingredients such as perfume microcapsules, be easily poured/dosed and minimizes residue build up in laundry machine dispensers. In addition, such compositions have tunable rheologies.

21 Claims, No Drawings

FLUID FABRIC ENHANCER COMPOSITIONS

CROSS-REFERENCE TO RELATED APPLICATIONS

This application claims priority under 35 U.S.C. §119(e) to U.S. Provisional Application Ser. No. 61/533,980, filed Sep. 13, 2011.

FIELD OF THE INVENTION

The present invention relates to fluid fabric enhancer compositions and processes for making and using same.

BACKGROUND OF THE INVENTION

Today's consumers desire high performance fluid fabric enhancer compositions having sufficient structuring to give a rich impression and stabilize/suspend performance ingredients such as perfume microcapsules and softener particles. Current fluid fabric enhancers resort to external structurants to obtain such benefits. Unfortunately, when such current external structurants are employed in fluid fabric enhancer compositions, such compositions are difficult to: pour from a container, dose from laundry machine dispensers as the composition's thickness causes "lump" dosing rather than continuous dosing, and clean from the dispenser. In fact, in many cases fluid fabric enhancer residues remain in the dispenser even after the dispenser is washed with water. Thus what is needed is a fluid fabric enhancer composition that offers the aforementioned benefits without the rheology negatives given above.

Applicants recognized that the source of the aforementioned rheology negatives was grounded in covalent interactions/bonds that the external structurant formed in the fluid fabric enhancer composition—such interactions/bonds are difficult to break and thus result in the fluid fabric enhancer having a low shear thinning profile. As a result, Applicants disclose fluid fabric enhancer compositions that have a rich impression, that stabilize/suspend performance ingredients such as perfume microcapsules and softener particles. Applicants' fluid fabric enhancer compositions minimize/do not have the negatives of current fluid fabric enhancer compositions as they have a shear thinning profile that allows such compositions to be easily poured/dosed and that minimizes residue build up in laundry machine dispensers. While not being bound by theory, Applicants believe that such advantages are achieved as the external structurants that Applicants employ in their fluid fabric enhancer products are self assembling via hydrogen bonding instead of covalent interactions. Such external structurants also provide Applicants fluid fabric enhancers with tunable rheologies.

SUMMARY OF THE INVENTION

Fluid fabric enhancer compositions comprising external structurants and processes for making and using same.

DETAILED DESCRIPTION OF THE INVENTION

Definitions

As used herein, articles such as "a" and "an" when used in a claim, are understood to mean one or more of what is claimed or described.

As used herein, the terms "include", "includes" and "including" are meant to be non-limiting.

As used herein, the term "solid" includes granular, powder, bar and tablet product forms.

As used herein, the term "fluid" includes liquid, gel and paste product forms.

As used herein, the term "situs" includes paper products, fabrics, garments, hard surfaces, hair and skin.

As used herein "neat perfume composition" means a perfume composition that is not contained in a perfume delivery composition.

As used herein, "non-aminofunctional organic solvent" refers to any organic solvent which contains no amino functional groups.

Unless otherwise noted, all component or composition levels are in reference to the active portion of that component or composition, and are exclusive of impurities, for example, residual solvents or by-products, which may be present in commercially available sources of such components or compositions.

All percentages and ratios are calculated by weight unless otherwise indicated. All percentages and ratios are calculated based on the total composition unless otherwise indicated.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Fluid Fabric Enhancer Composition

A fluid fabric enhancer composition comprising:

a) from about 0.5% to about 90%, from about 2% to about 70%, from about 4% to about 40%, or even from about 5% to about 25% by weight of a fabric softener active; and b) from about 0.01 wt % to about 5 wt % from about 0.05 wt % to about 2 wt % or even from about 0.1 wt % to about 0.5 wt % of a pH tuneable di-amido gellant having following formula:

[I]

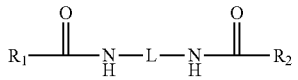

wherein $R_1$ and $R_2$ are aminofunctional end-groups; L is a backbone moiety having molecular weight from about 14 g/mol to about 500 g/mol; and at least one of L, $R_1$ or $R_2$ comprises a pH-sensitive group selected from the group consisting of

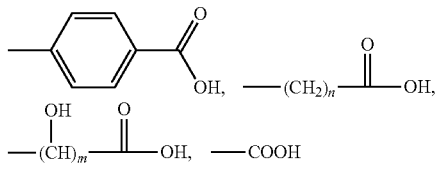

wherein the indices n and m are integers from 1 to 20 and the ring aromatic ring moiety of the pH-sensitive group

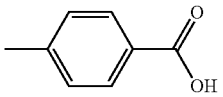

is optionally substituted at one or more of positions 2, 3, 5 and/or 6 said pH tuneable di-amido-gellant having a pKa of from about 0 to about 30 is disclosed.

In one aspect of said fluid fabric enhancer composition, said fabric softener active may be selected from the group consisting of quats, amines, fatty esters, sucrose esters, silicones, dispersible polyolefins, clays, polysaccharides, fatty oils, polymer latexes, fatty acids, triglycerides, fatty alcohols, fatty amides, fatty amines, dispersible polyethylenes, and mixtures thereof.

In one aspect of said fluid fabric enhancer composition, said pH tuneable di-amido gellant may have a pKa of from about 1.5 to about 14, or even from about 2 to about 9.

In one aspect of said fluid fabric enhancer composition, said pH tuneable di-amido gellant may have a molecular weight from about 150 to about 1,500 g/mol, or from about 300 g/mol to about 900 g/mol, or even from about 400 g/mol to about 700 g/mol.

In one aspect of said fluid fabric enhancer composition, said pH tuneable di-amido gellant may have a minimum gelling concentration (MGC) of from about 0.1 to about 50 mg/mL, from about 0.1 to about 12.5 mg/mL, or even from about 0.5 to about 5 mg/mL in water, at the target pH of the fluid fabric enhancer composition. The MGC as used herein can be represented as mg/ml or as a wt %, where wt % is calculated as the MGC in mg/ml divided by 10. While the invention includes fluid fabric enhancer compositions having a pH tuneable di-amido gellant concentration either above or below the MGC, the pH tuneable di-amido gellants of the invention result in particularly useful rheologies below the MGC.

In one aspect of said fluid fabric enhancer composition, said pH tuneable di-amido gellant may be selected from the group consisting of (6S,13S)-6,13-diisopropyl-4,7,12,15-tetraoxo-5,8,11,14-tetraazaoctadecane-1,18-dioic acid, (6S,14S')-6,14-diisopropyl-4,7,13,16-tetraoxo-5,8,12,15-tetraazanonadecane-1,19-dioic acid, (6S,15S)-6,15-diisopropyl-4,7,14,17-tetraoxo-5,8,13,16-tetraazaeicosane-1,20-dioic acid, (6S,16S)-6,16-diisopropyl-4,7,15,18-tetraoxo-5,8,14,17-tetraazaheneicosane-1,21-dioic acid, (6S,17S)-6,17-diisopropyl-4,7,16,19-tetraoxo-5,8,15,18-tetraazadocosane-1,22-dioic acid, (6S,18S)-6,18-diisopropyl-4,7,17,20-tetraoxo-5,8,16,19-tetraazatricosane-1,23-dioic acid, (6S,19S)-6,19-diisopropyl-4,7,18,21-tetraoxo-5,8,17,20-tetraazatetracosane-1,24-dioic acid, (6S,20S)-6,20-diisopropyl-4,7,19,22-tetraoxo-5,8,18,21-tetraazapentacosane-1,25-dioic acid, (6S,21S)-6,21-diisopropyl-4,7,20,23-tetraoxo-5,8,19,22-tetraazahexacosane-1,26-dioic acid, (6S,22S)-6,22-diisopropyl-4,7,21,24-tetraoxo-5,8,20,23-tetraazaheptacosane-1,27-dioic acid, (6S,23S)-6,23-diisopropyl-4,7,22,25-tetraoxo-5,8,21,24-tetraazaoctacosane-1,28-dioic acid, 4-[[(1S)-1-[2-[[(2S)-2-[(4-hydroxy-4-oxo-butanoyl)amino]-3-methyl-pentanoyl]amino]ethylcarbamoyl]-2-methyl-butyl]amino]-4-oxo-butanoicacid, 4-[[(1S)-1-[3-[[(2S)-2-[(4-hydroxy-4-oxo-butanoyl)amino]-3-methyl-pentanoyl]amino]propylcarbamoyl]-2-methyl-butyl]amino]-4-oxo-butanoic acid, 4-[[(1S)-1-[4-[[(2S)-2-[(4-hydroxy-4-oxo-butanoyl)amino]-3-methyl-pentanoyl]amino]butylcarbamoyl]-2-methyl-butyl]amino]-4-oxo-butanoic acid, 4-[[(1S)-1-[5-[[(2S)-2-[(4-hydroxy-4-oxo-butanoyl)amino]-3-methyl-pentanoyl]amino]heptylcarbamoyl]-2-methyl-butyl]amino]-4-oxo-butanoic acid, 4-[[(1S)-1-[8-[[(2S)-2-[(4-hydroxy-4-oxo-butanoyl)amino]-3-methyl-pentanoyl]amino]hexylcarbamoyl]-2-methyl-butyl]amino]-4-oxo-butanoic acid, 4-[[(1S)-1-[7-[[(2S)-2-[(4-hydroxy-4-oxo-butanoyl)amino]-3-methyl-pentanoyl]amino]heptylcarbamoyl]-2-methyl-butyl]amino]-4-oxo-butanoic acid, 4-[[(1S)-1-[8-[[(2S)-2-[(4-hydroxy-4-oxo-butanoyl)amino]-3-methyl-pentanoyl]amino]octylcarbamoyl]-2-methyl-butyl]amino]-4-oxo-butanoic acid, 4-[[(1S)-1-[9-[[(2S)-2-[(4-hydroxy-4-oxo-butanoyl)amino]-3-methyl-pentanoyl]amino]nonylcarbamoyl]-2-methyl-butyl]amino]-4-oxo-butanoic acid, 4-[[(1S)-1-[10-[[(2S)-2-[(4-hydroxy-4-oxo-butanoyl)amino]-3-methyl-pentanoyl]amino]decylcarbamoyl]-2-methyl-butyl]amino]-4-oxo-butanoic acid, 4-[[(1S)-1-[11-[[(2S)-2-[(4-hydroxy-4-oxo-butanoyl)amino]-3-methyl-pentanoyl]amino]undecylcarbamoyl]-2-methyl-butyl]amino]-4-oxo-butanoic acid, 4-[[(1S)-1-[12-[[(2S)-2-[(4-hydroxy-4-oxo-butanoyl)amino]-3-methyl-pentanoyl]amino]dodecylcarbamoyl]-2-methyl-butyl]amino]-4-oxo-butanoic acid, 4-[[(1S)-1-benzyl-2-[2-[[(2S)-2-[(4-hydroxy-4-oxo-butanoyl)amino]-3-phenyl-propanoyl]amino]ethylamino]-2-oxo-ethyl]amino]-4-oxo-butanoic acid, 4-[[(1S)-1-benzyl-2-[3-[[(2S)-2-[(4-hydroxy-4-oxo-butanoyl)amino]-3-phenyl-propanoyl]amino]propylamino]-2-oxo-ethyl]amino]-4-oxo-butanoic acid, 4-[[(1S)-1-benzyl-2-[4-[[(2S)-2-[(4-hydroxy-4-oxo-butanoyl)amino]-3-phenyl-propanoyl]amino]butylamino]-2-oxo-ethyl]amino]-4-oxo-butanoic acid, 4-[[(1S)-1-benzyl-2-[5-[[(2S)-2-[(4-hydroxy-4-oxo-butanoyl)amino]-3-phenyl-propanoyl]amino]pentylamino]-2-oxo-ethyl]amino]-4-oxo-butanoic acid, 4-[[(1S)-1-benzyl-2-[6-[[(2S)-2-[(4-hydroxy-4-oxo-butanoyl)amino]-3-phenyl-propanoyl]amino]hexylamino]-2-oxo-ethyl]amino]-4-oxo-butanoic acid, 4-[[(1S)-1-benzyl-2-[7-[[(2S)-2-[(4-hydroxy-4-oxo-butanoyl)amino]-3-phenyl-propanoyl]amino]heptylamino]-2-oxo-ethyl]amino]-4-oxo-butanoic acid, 4-[[(1S)-1-benzyl-2-[8-[[(2S)-2-[(4-hydroxy-4-oxo-butanoyl)amino]-3-phenyl-propanoyl]amino]octylamino]-2-oxo-ethyl]amino]-4-oxo-butanoic acid, 4-[[(1S)-1-benzyl-2-[9-[[(2S)-2-[(4-hydroxy-4-oxo-butanoyl)amino]-3-phenyl-propanoyl]amino]nonylamino]-2-oxo-ethyl]amino]-4-oxo-butanoic acid, 4-[[(1S)-1-benzyl-2-[10-[[(2S)-2-[(4-hydroxy-4-oxo-butanoyl)amino]-3-phenyl-propanoyl]amino]decylamino]-2-oxo-ethyl]amino]-4-oxo-butanoic acid, 4-[[(1S)-1-benzyl-2-[11-[[(2S)-2-[(4-hydroxy-4-oxo-butanoyl)amino]-3-phenyl-propanoyl]amino]undecylamino]-2-oxo-ethyl]amino]-4-oxo-butanoic acid, 4-[[(1S)-1-benzyl-2-[12-[[(2S)-2-[(4-hydroxy-4-oxo-butanoyl)amino]-3-phenyl-propanoyl]amino]dodecylamino]-2-oxo-ethyl]amino]-4-oxo-butanoic acid, 4-[2-[[(1S)-1-[2-[[(2S)-2-[[2-(4-carboxyphenyl)acetyl]amino]-3-methyl-pentanoyl]amino]ethylcarbamoyl]-2-methyl-butyl]amino]-2-oxo-ethyl]benzoic acid, 4-[2-[[(1S)-1-[3-[[(2S)-2-[[2-(4-carboxyphenyl)acetyl]amino]-3-methyl-pentanoyl]amino]propylcarbamoyl]-2-methyl-butyl]amino]-2-oxo-ethyl]benzoic acid, 4-[2-[[(1S)-1-[4-[[(2S)-2-[[2-(4-carboxyphenyl)acetyl]amino]-3-methyl-pentanoyl]amino]buylcarbamoyl]-2-methyl-butyl]amino]-2-oxo-ethyl]benzoic acid, 4-[2-[[(1S)-1-[5-[[(2S)-2-[[2-(4-carboxyphenyl)acetyl]amino]-3-methyl-pentanoyl]amino]pentylcarbamoyl]-2-methyl-butyl]amino]-2-oxo-ethyl]benzoic acid, 4-[2-[[(1S)-1-[6-[[(2S)-2-[[2-(4-carboxyphenyl)acetyl]amino]-3-methyl-pentanoyl]amino]hexylcarbamoyl]-2-methyl-butyl]amino]-2-oxo-ethyl]benzoic acid, 4-[2-[[(1S)-1-[7-[[(2S)-2-[[2-(4-carboxyphenyl)acetyl]amino]-3-methyl-pentanoyl]amino] heptylcarbamoyl]-2-methyl-butyl]amino]-2-oxo-ethyl] benzoic acid, -[2-[[(1S)-1-[8-[[(2S)-2-[[2-(4-carboxyphenyl)acetyl]amino]-3-methyl-pentanoyl]amino] octylcarbamoyl]-2-methyl-butyl]amino]-2-oxo-ethyl] benzoic acid, 4-[2-[[(1S)-1-[9-[[(2S)-2-[[2-(4-carboxyphenyl)acetyl]amino]-3-methyl-pentanoyl]amino] nonylcarbamoyl]-2-methyl-butyl]amino]-2-oxo-ethyl] benzoic acid, 4-[2-[[(1S)-1-[10-[[(2S)-2-[[2-(4-carboxyphenyl)acetyl]amino]-3-methyl-pentanoyl]amino] decylcarbamoyl]-2-methyl-butyl]amino]-2-oxo-ethyl] benzoic acid, 4-[2-[[(1S)-1-[11-[[(2S)-2-[[2-(4-carboxyphenyl)acetyl]amino]-3-methyl-pentanoyl]amino] undecylcarbamoyl]-2-methyl-butyl]amino]-2-oxo-ethyl] benzoic acid, 4-[2-[[(1S)-1-[12-[[(2S)-2-[[2-(4-carboxyphenyl)acetyl]amino]-3-methyl-pentanoyl]amino] dodecylcarbamoyl]-2-methyl-butyl]amino]-2-oxo-ethyl] benzoic acid, and mixtures thereof.

In one aspect of said fluid fabric enhancer composition, said pH tuneable di-amido gellant may be selected from the group consisting of (6S,18S)-6,18-diisopropyl-4,7,17,20-tetraoxo-5,8,16,19-tetraazatricosane-1,23-dioic acid, (6S,19S)-6,19-diisopropyl-4,7,18,21-tetraoxo-5,8,17,20-tetraazatetracosane-1,24-dioic acid, (6S,20S)-6,20-diisopropyl-4,7,19,22-tetraoxo-5,8,18,21-tetraazapentacosane-1,25-dioic acid, (6S,21S)-6,21-diisopropyl-4,7,20,23-tetraoxo-5,8,19,22-tetraazahexacosane-1,26-dioic acid, (6S,22S)-6,22-diisopropyl-4,7,21,24-tetraoxo-5,8,20,23-tetraazaheptacosane-1,27-dioic acid, (6S,23S)-6,23-diisopropyl-4,7,22,25-tetraoxo-5,8,21,24-tetraazaoctacosane-1,28-dioic acid, 4-[[(1S)-1-[6-[[(2S)-2-[(4-hydroxy-4-oxo-butanoyl)amino]-3-methyl-pentanoyl]amino]hexylcarbamoyl]-2-methyl-butyl]amino]-4-oxo-butanoic acid, 4-[[(1S)-1-[7-[[(2S)-2-[(4-hydroxy-4-oxo-butanoyl)amino]-3-methyl-pentanoyl]amino] heptylcarbamoyl]-2-methyl-butyl]amino]-4-oxo-butanoic acid, 4-[[(1S)-1-[8-[[(2S)-2-[(4-hydroxy-4-oxo-butanoyl) amino]-3-methyl-pentanoyl]amino]octylcarbamoyl]-2-methyl-butyl]amino]-4-oxo-butanoic acid, 4-[[(1S)-1-[9-[[(2S)-2-[(4-hydroxy-4-oxo-butanoyl)amino]-3-methyl-pentanoyl] amino]nonylcarbamoyl]-2-methyl-butyl]amino]-4-oxo-butanoic acid, 4-[[(1S)-1-[10-[[(2S)-2-[(4-hydroxy-4-oxo-butanoyl)amino]-3-methyl-pentanoyl]amino] decylcarbamoyl]-2-methyl-butyl]amino]-4-oxo-butanoic acid, 4-[[(1S)-1-[11-[[(2S)-2-[(4-hydroxy-4-oxo-butanoyl) amino]-3-methyl-pentanoyl]amino]undecylcarbamoyl]-2-methyl-butyl]amino]-4-oxo-butanoic acid, 4-[[(1S)-1-[12-[[(2S)-2-[(4-hydroxy-4-oxo-butanoyl)amino]-3-methyl-pentanoyl]amino]dodecylcarbamoyl]-2-methyl-butyl] amino]-4-oxo-butanoic acid, 4-[[(1S)-1-benzyl-2-[6-[[(2S)-2-[(4-hydroxy-4-oxo-butanoyl)amino]-3-phenyl-propanoyl] amino]hexylamino]-2-oxo-ethyl]amino]-4-oxo-butanoic acid, 4-[[(1S)-1-benzyl-2-[7-[[(2S)-2-[(4-hydroxy-4-oxo-butanoyl)amino]-3-phenyl-propanoyl]amino]heptylamino]-2-oxo-ethyl]amino]-4-oxo-butanoic acid, 4-[[(1S)-1-benzyl-2-[8-[[(2S)-2-[(4-hydroxy-4-oxo-butanoyl)amino]-3-phenyl-propanoyl]amino]octylamino]-2-oxo-ethyl]amino]-4-oxo-butanoic acid, 4-[[(1S)-1-benzyl-2-[9-[[(2S)-2-[(4-hydroxy-4-oxo-butanoyl)amino]-3-phenyl-propanoyl] amino]nonylamino]-2-oxo-ethyl]amino]-4-oxo-butanoic acid, 4-[[(1S)-1-benzyl-2-[10-[[(2S)-2-[(4-hydroxy-4-oxo-butanoyl)amino]-3-phenyl-propanoyl]amino]decylamino]-2-oxo-ethyl]amino]-4-oxo-butanoic acid, 4-[[(1S)-1-benzyl-2-[11-[[(2S)-2-[(4-hydroxy-4-oxo-butanoyl)amino]-3-phenyl-propanoyl]amino]undecylamino]-2-oxo-ethyl] amino]-4-oxo-butanoic acid, 4-[[(1S)-1-benzyl-2-[12-[[(2S)-2-[(4-hydroxy-4-oxo-butanoyl)amino]-3-phenyl-propanoyl]amino]dodecylamino]-2-oxo-ethyl]amino]-4-oxo-butanoic acid, 4-[2-[[(1S)-1-[6-[[(2S)-2-[[2-(4-carboxyphenyl)acetyl]amino]-3-methyl-pentanoyl]amino]hexyl-carbamoyl]-2-methyl-butyl]amino]-2-oxo-ethyl]benzoic acid, 4-[2-[[(1S)-1-[7-[[(2S)-2-[[2-(4-carboxyphenyl)acetyl] amino]-3-methyl-pentanoyl]amino]heptylcarbamoyl]-2-methyl-butyl]amino]-2-oxo-ethyl]benzoic acid, -[2-[[(1S)-1-[8-[[(2S)-2-[[2-(4-carboxyphenyl)acetyl]amino]-3-methyl-pentanoyl]amino]octylcarbamoyl]-2-methyl-butyl]amino]-2-oxo-ethyl]benzoic acid, 4-[2-[[(1S)-1-[9-[[(2S)-2-[[2-(4-carboxyphenyl)acetyl]amino]-3-methyl-pentanoyl]amino] nonylcarbamoyl]-2-methyl-butyl]amino]-2-oxo-ethyl] benzoic acid, 4-[2-[[(1S)-1-[10-[[(2S)-2-[[2-(4-carboxyphenyl)acetyl]amino]-3-methyl-pentanoyl]amino] decylcarbamoyl]-2-methyl-butyl]amino]-2-oxo-ethyl] benzoic acid, 4-[2-[[(1S)-1-[11-[[(2S)-2-[[2-(4-carboxyphenyl)acetyl]amino]-3-methyl-pentanoyl]amino] undecylcarbamoyl]-2-methyl-butyl]amino]-2-oxo-ethyl] benzoic acid, 4-[2-[[(1S)-1-[12-[[(2S)-2-[[2-(4-carboxyphenyl)acetyl]amino]-3-methyl-pentanoyl]amino] dodecylcarbamoyl]-2-methyl-butyl]amino]-2-oxo-ethyl] benzoic acid, and mixtures thereof.

In one aspect of said fluid fabric enhancer composition, said pH tuneable di-amido gellant may be selected from the group consisting of (6S,20S)-6,20-diisopropyl-4,7,19,22-tetraoxo-5,8,18,21-tetraazapentacosane-1,25-dioic acid, (6S,23S)-6,23-diisopropyl-4,7,22,25-tetraoxo-5,8,21,24-tetraazaoctacosane-1,28-dioic acid, 4-[[(1S)-1-[8-[[(2S)-2-[(4-hydroxy-4-oxo-butanoyl)amino]-3-methyl-pentanoyl] amino]octylcarbamoyl]-2-methyl-butyl]amino]-4-oxo-butanoic acid, 4-[[(1S)-1-[12-[[(2S)-2-[(4-hydroxy-4-oxo-butanoyl)amino]-3-methyl-pentanoyl]amino] dodecylcarbamoyl]-2-methyl-butyl]amino]-4-oxo-butanoic acid, 4-[[(1S)-1-benzyl-2-[8-[[(2S)-2-[(4-hydroxy-4-oxo-butanoyl)amino]-3-phenyl-propanoyl]amino]octylamino]-2-oxo-ethyl]amino]-4-oxo-butanoic acid, 4-[[(1S)-1-benzyl-2-[12-[[(2S)-2-[(4-hydroxy-4-oxo-butanoyl)amino]-3-phenyl-propanoyl]amino]dodecylamino]-2-oxo-ethyl] amino]-4-oxo-butanoic acid, -[2-[[(1S)-1-[8-[[(2S)-2-[[2-(4-carboxyphenyl)acetyl]amino]-3-methyl-pentanoyl]amino] octylcarbamoyl]-2-methyl-butyl]amino]-2-oxo-ethyl] benzoic acid, 4-[2-[[(1S)-1-[12-[[(2S)-2-[[2-(4-carboxyphenyl)acetyl]amino]-3-methyl-pentanoyl]amino] dodecylcarbamoyl]-2-methyl-butyl]amino]-2-oxo-ethyl] benzoic acid, and mixtures thereof.

In one aspect of said fluid fabric enhancer composition, said composition may comprise an adjunct ingredient.

In one aspect of said fluid fabric enhancer composition, said composition may comprise from about 0.01% to about 10%, or from about 0.1% to about 5%, or even from about 0.2% to about 2% of a neat perfume composition.

In one aspect of said fluid fabric enhancer composition, said composition may comprise one or more perfume delivery systems.

In one aspect of said fluid fabric enhancer composition, said composition additionally may comprise a perfume microcapsule.

In one aspect of said fluid fabric enhancer composition, said composition additionally may comprise a perfume microcapsule that comprises an aminoplast material, polyamide material and/or an acrylate material.

In one aspect, the fluid fabric enhancer composition said composition additionally comprises a perfume microcapsule comprising a cationic, nonionic and/or anionic deposition aid.

In one aspect of said fluid fabric enhancer composition, said composition additionally may comprise a perfume microcapsule comprising a deposition aid selected from the group consisting of, a cationic polymer, a nonionic polymer, an anionic polymer and mixtures thereof.

In one aspect of said fluid fabric enhancer composition, said perfume microcapsule may comprise a cationic polymer.

In one aspect, the pH tuneable di-amido gellant may impart a shear thinning viscosity profile to the fluid fabric enhancer composition, independently from, or extrinsic from, any structuring effect of the surfactants of the composition. In one aspect, such pH tuneable di-amido gellants may include those which provide a pouring viscosity from about 50 cps to about 20,000 cps, from about 100 cps to about 10,000 cps, or even from about 200 cps to about 7,000 cps.

The pouring viscosity is measured at a shear rate of 20 $sec^{-1}$, which is a shear rate that the fluid fabric enhancer composition is typically exposed to during pouring. The viscosity is measured at 21° C. using a TA AR 2000 (or AR G2) rheometer with a 40 mm stainless steel plate having a gap of 500 microns.

In one aspect, the pH tuneable di-amido gellant may provide the fluid fabric enhancer composition with a viscosity profile that is dependent on the pH of the composition. The pH tuneable di-amido gellants may comprise at least one pH sensitive group. When a pH tuneable amido gellant is added to a polar protic solvent such as water, it is believed that the nonionic species form the viscosity building network while the ionic species are soluble and do not form a viscosity building network. By increasing or decreasing the pH (depending on the selection of the pH-sensitive groups) the amido gellant is either protonated or deprotonated. Thus, by changing the pH of the solution, the solubility, and hence the viscosity building behaviour, of the amido gellant can be controlled. By proper selection of the pH-sensitive groups, the pKa of the amido gellant can be tailored. Hence, the choice of the pH-sensitive groups can be used to select the pH at which the amido gellant builds viscosity.

Unit Dose Forms

In one aspect of said fluid fabric enhancer composition, said composition may be enclosed within a water soluble pouch material, in one aspect, comprising polyvinyl alcohols, polyvinyl alcohol copolymers and hydroxypropyl methyl cellulose (HPMC), and combinations thereof.

In one aspect, said water soluble pouch can be of any form, shape and material which is suitable for holding the fluid fabric enhancer composition, i.e. without allowing the release of the fluid fabric enhancer composition, and any additional ingredient, from said water soluble pouch prior to contact of the water soluble pouch with water. The exact execution will depend, for example, on the type and amount of the compositions in the water soluble pouch, the number of compartments in the water soluble pouch, and on the characteristics required from the water soluble pouch to hold, protect and deliver or release the fluid fabric enhancer compositions or ingredients.

The water soluble pouch may comprise a water-soluble film which fully encloses at least one compartment, comprising the fluid fabric enhancer composition. The water soluble pouch may optionally comprise additional compartments comprising fluid, solids, and mixtures thereof. Alternatively, any additional solid ingredient may be suspended in a fluid-filled compartment. A multi-compartment water soluble pouch may be desirable for such reasons as: separating chemically incompatible ingredients; or where it is desirable for a portion of the ingredients to be released into the wash earlier or later.

Water-Soluble Film: The water-soluble film typically may have a solubility of at least 50%, at least 75%, or even at least 95%. The method for determining water-solubility of the film is given in the Test Methods. The water-soluble film typically has a dissolution time of less than 100 seconds, less than 85 seconds, less than 75 seconds, or even less than 60 seconds. The method for determining the dissolution time of the film is given in the Test Methods.

In one aspect, said films are polymeric materials, such as polymers which are formed into a film or sheet. The film can be obtained by casting, blow-moulding, extrusion or blow extrusion of the polymer material, as known in the art. In one aspect, the water-soluble film may comprise: polymers, copolymers or derivatives thereof, including polyvinyl alcohols (PVA), polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthan gum and carragum, and mixtures thereof. In another aspect, the water-soluble film may comprise: polyacrylates and water-soluble acrylate copolymers, methylcellulose, carboxymethylcellulose, dextrin, ethylcellulose, hydroxyethyl cellulose, hydroxypropyl methylcellulose, maltodextrin, polymethacrylates, and mixtures thereof. In still another aspect, the water-soluble film may comprise: polyvinyl alcohols, polyvinyl alcohol copolymers, hydroxypropyl methyl cellulose (HPMC), and mixtures thereof. In one aspect, the level of polymer or copolymer in the film is at least 60% by weight. In one aspect, the polymer or copolymer has a weight average molecular weight of from 1,500 to 1,000,000, from 10,000 to 300,000, from 15,000 to 200,000, or even from 20,000 to 150,000 g/mol.

Copolymers and mixtures of polymers can also be used. In particular, this may be beneficial to control the mechanical and/or dissolution properties of the compartments of the water soluble pouch, depending on the application thereof and the required needs. For example, a water soluble pouch may comprise a mixture of polymers in the film, whereby one polymer material has a higher water-solubility than another polymer material, and/or one polymer material has a higher mechanical strength than another polymer material. Using copolymers and mixtures of polymers may have other benefits, including improved long-term resiliency of the water-soluble or dispersible film to the fluid composition ingredients. For instance, U.S. Pat. No. 6,787,512 discloses polyvinyl alcohol copolymer films comprising a hydrolyzed copolymer of vinyl acetate and a second sulfonic acid monomer, for improved resiliency against detergent ingredients. An example of such a film is sold by Monosol of Merrillville, Ind., US, under the brand name: M8900. In one aspect, a mixture of polymers is used, having different weight average molecular weights, for example a mixture of polyvinyl alcohol or a copolymer thereof, of a weight average molecular weight of from 10,000 to 40,000 g/mol, and of another polyvinyl alcohol or copolymer, with a weight average molecular weight of from 100,000 to 300,000 g/mol. US 2011/0189413 discloses example of blend of polyvinyl alcohol with different molecular weight.

Also useful are polymer blend compositions, for example comprising hydrolytically degradable and water-soluble polymer blends such as polylactide and polyvinyl alcohol, achieved by the mixing of polylactide and polyvinyl alcohol, typically comprising 1 to 35% by weight of the film of polylactide, and from 65% to 99% by weight of polyvinyl alcohol. In one aspect, the polymer present in the film may be from about 60% to about 98% hydrolysed, or even from about 80% to about 90%, to improve the dissolution/dispersion of the film material.

The water-soluble film herein may comprise additive ingredients other than the polymer or copolymer material. For example, it may be beneficial to add: plasticisers such as glycerol, ethylene glycol, diethyleneglycol, propylene glycol, sorbitol and mixtures thereof; additional water; and/or disintegrating aids.

Other suitable examples of commercially available water-soluble films include polyvinyl alcohol and partially hydrolysed polyvinyl acetate, alginates, cellulose ethers such as carboxymethylcellulose and methylcellulose, polyethylene oxide, polyacrylates and combinations of these.

pH Tuneable Di-amido Gellants

The pH tuneable di-amido gellants listed for use in fluid fabric enhancers herein may have one or more of the following characteristics:

In one aspect of said pH tuneable di-amido gellant, said $R_1$ and $R_2$ end-groups may comprise amidofunctional end groups.

In one aspect, said pH tuneable di-amido gellant may comprise at least one amido functional group, and further may comprise at least one pH-sensitive group.

In one aspect, L has the formula:

$$L=A_a\text{-}B_b\text{-}C_c\text{-}D_d, \qquad [III]$$

wherein: (a+b+c+d) is from 1 to 20; and A, B, C and D are independently selected from the linking groups consisting of:

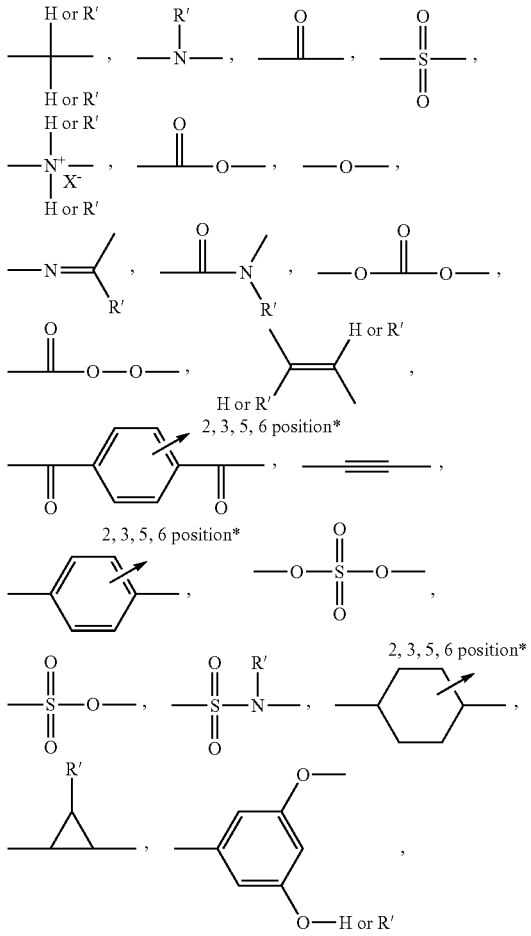

-continued

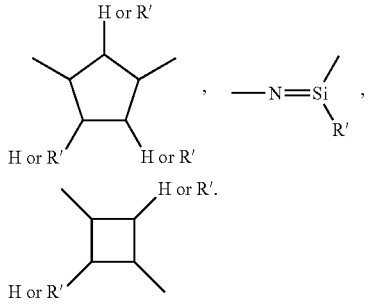

*the arrow indicates up to 4 substitutions in the positions indicated, and $X^-$ an anion In one aspect, L is selected from C2 to C20 hydrocarbyl chains, from $C_6$ to $C_{12}$, or even from $C_8$ to $C_{10}$.

In one aspect, $R_1$ is $R_3$ or

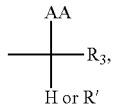

$R_2$ is $R_4$ or

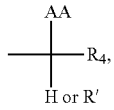

wherein each AA is independently selected from the group consisting of:

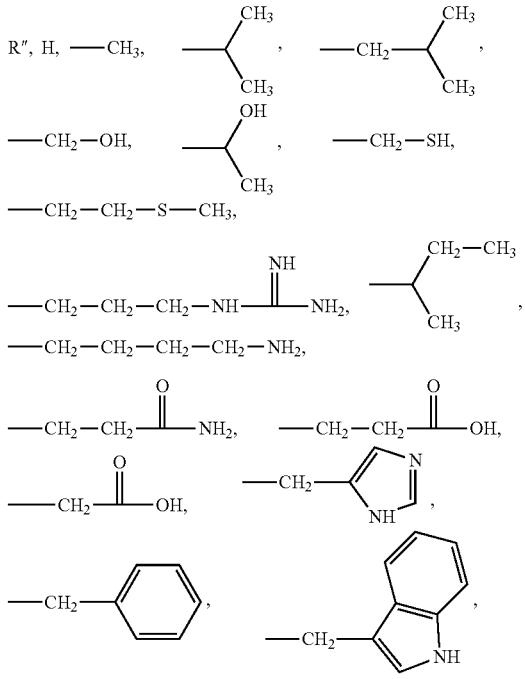

-continued

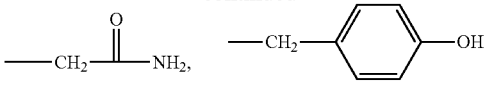

and $R_3$ and $R_4$ independently have the formula:

$$(L')_o\text{-}(L'')_q\text{-}R, \qquad [IV]$$

wherein:

(o+q) is from 1 to 10; L' and L" are linking groups, independently selected from the same groups as A, B, C and D in equation [III]; and R, R' and R" are independently selected either from the same group as AA, either from the pH-sensitive-groups consisting of:

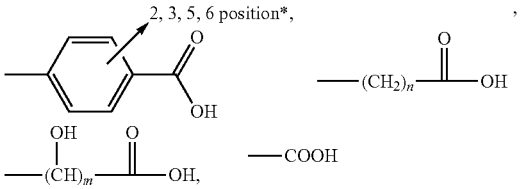

*the arrow indicates up to 4 substitutions in the positions indicated, n and m are integers from 1 to 20 or from the non-pH-sensitive groups consisting of:

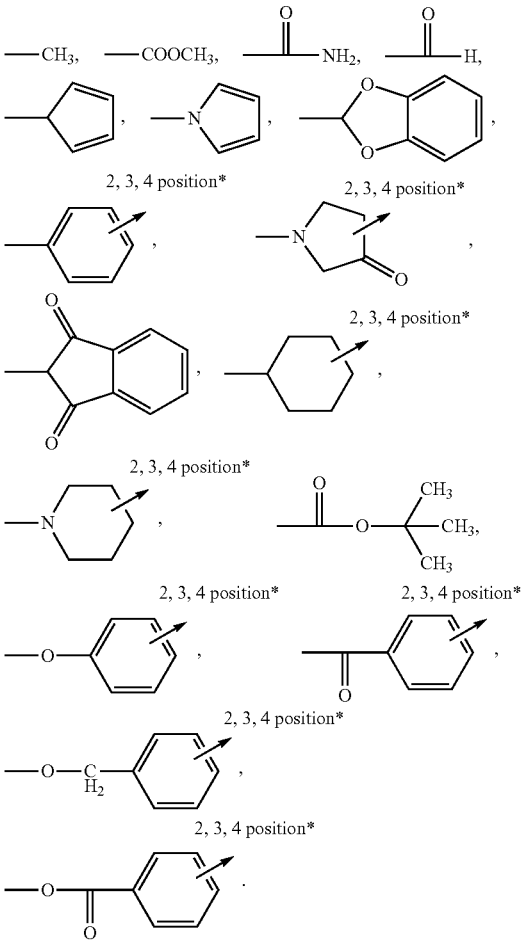

such that at least one of L, R, R' and R" comprises at least one pH-sensitive group. In one aspect, R may comprise the pH-sensitive group.

In one aspect, the pH tuneable di-amido gellant having structure [I] is characterized in that: L is an aliphatic linking group with a backbone chain of from 2 to 20 carbon atoms, in one aspect, L may be —$(CH_2)_n$— wherein n is selected from 2 to 20, and both $R_1$ and $R_2$ have the structure:

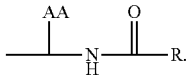

in one aspect, AA is selected from the group consisting of:

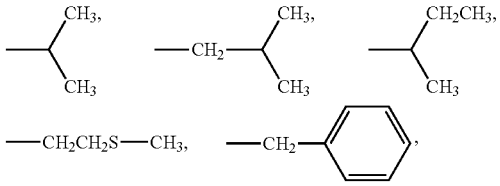

and R is selected from the pH-sensitive groups consisting of:

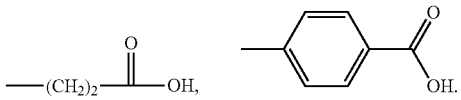

In another aspect, two or more of L, L' and L" are the same group.

The pH tuneable di-amido gellant described in formula [I] can be symmetric with respect to the L entity or can be asymmetric. Without intending to be bound by theory, it is believed that symmetric pH tuneable di-amido gellants allow for more orderly structured networks to form, whereas compositions comprising one or more asymmetric pH tuneable di-amido gellants can create disordered networks.

Suitable pH tuneable di-amido gellants having structure [I] may be selected from Table 1. In one aspect of both types of pH tuneable amido gellant structures, AA may comprise at least one of: Alanine, β-Alanine and substituted Alanines; Linear Amino-Alkyl Carboxylic Acid; Cyclic Amino-Alkyl Carboxylic Acid; Aminobenzoic Acid Derivatives; Aminobutyric Acid Derivatives; Arginine and Homologues; Asparagine; Aspartic Acid; p-Benzoyl-Phenylalanine; Biphenylalanine; Citrulline; Cyclopropylalanine; Cyclopentylalanine; Cyclohexylalanine; Cysteine, Cystine and Derivatives; Diaminobutyric Acid Derivatives; Diaminopropionic Acid; Glutamic Acid Derivatives; Glutamine; Glycine; Substituted Glycines; Histidine; Homoserine; Indole Derivatives; Isoleucine; Leucine and Derivatives; Lysine; Methionine; Naphthylalanine; Norleucine; Norvaline; Ornithine; Phenylalanine; Ring-Substituted Phenylalanines; Phenylglycine; Pipecolic Acid, Nipecotic Acid and Isonipecotic Acid; Proline; Hydroxyproline; Thiazolidine; Pyridylalanine; Serine; Statine and Analogues; Threonine; Tetrahydronorharman-3-carboxylic Acid; 1,2,3,4-Tetrahydroisoquinoline; Tryptophane; Tyrosine; Valine; and combinations thereof.

TABLE 1

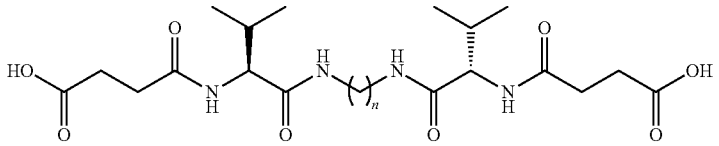

| | |
|---|---|
| (6S,14S')-6,14-diisopropyl-4,7,13,16-tetraoxo-5,8,12,15-tetraazanonadecane-1,19-dioic acid | (6S,13S)-6,13-diisopropyl-4,7,12,15-tetraoxo-5,8,11,14-tetraazaoctadecane-1,18-dioic acid |
| (6S,16S)-6,16-diisopropyl-4,7,15,18-tetraoxo-5,8,14,17-tetraazaheneicosane-1,21-dioic acid | (6S,15S)-6,15-diisopropyl-4,7,14,17-tetraoxo-5,8,13,16-tetraazaeicosane-1,20-dioic acid |
| (6S,18S)-6,18-diisopropyl-4,7,17,20-tetraoxo-5,8,16,19-tetraazatricosane-1,23-dioic acid | (6S,17S)-6,17-diisopropyl-4,7,16,19-tetraoxo-5,8,15,18-tetraazadocosane-1,22-dioic acid |
| (6S,20S)-6,20-diisopropyl-4,7,19,22-tetraoxo-5,8,18,21-tetraazapentacosane-1,25-dioic acid | (6S,19S)-6,19-diisopropyl-4,7,18,21-tetraoxo-5,8,17,20-tetraazatetracosane-1,24-dioic acid |
| (6S,22S)-6,22-diisopropyl-4,7,21,24-tetraoxo-5,8,20,23-tetraazaheptacosane-1,27-dioic acid | (6S,21S)-6,21-diisopropyl-4,7,20,23-tetraoxo-5,8,19,22-tetraazahexacosane-1,26-dioic acid |
| | (6S,23S)-6,23-diisopropyl-4,7,22,25-tetraoxo-5,8,21,24-tetraazaoctacosane-1,28-dioic acid |

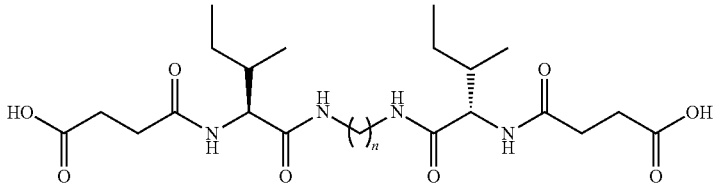

| | |
|---|---|
| 4-[[(1S)-1-[2-[[(2S)-2-[(4-hydroxy-4-oxo-butanoyl)amino]-3-methyl-pentanoyl]amino]ethylcarbamoyl]-2-methyl-butyl]amino]-4-oxo-butanoic acid | 4-[[(1S)-1-[3-[[(2S)-2-[(4-hydroxy-4-oxo-butanoyl)amino]-3-methyl-pentanoyl]amino]propylcarbamoyl]-2-methyl-butyl]amino]-4-oxo-butanoic acid |
| 4-[[(1S)-1-[4-[[(2S)-2-[(4-hydroxy-4-oxo-butanoyl)amino]-3-methyl-pentanoyl]amino]butylcarbamoyl]-2-methyl-butyl]amino]-4-oxo-butanoic acid | 4-[[(1S)-1-[5-[[(2S)-2-[(4-hydroxy-4-oxo-butanoyl)amino]-3-methyl-pentanoyl]amino]pentylcarbamoyl]-2-methyl-butyl]amino]-4-oxo-butanoic acid |
| 4-[[(1S)-1-[6-[[(2S)-2-[(4-hydroxy-4-oxo-butanoyl)amino]-3-methyl-pentanoyl]amino]hexylcarbamoyl]-2-methyl-butyl]amino]-4-oxo-butanoic acid | 4-[[(1S)-1-[7-[[(2S)-2-[(4-hydroxy-4-oxo-butanoyl)amino]-3-methyl-pentanoyl]amino]heptylcarbamoyl]-2-methyl-butyl]amino]-4-oxo-butanoic acid |
| 4-[[(1S)-1-[8-[[(2S)-2-[(4-hydroxy-4-oxo-butanoyl)amino]-3-methyl-pentanoyl]amino]octylcarbamoyl]-2-methyl-butyl]amino]-4-oxo-butanoic acid | 4-[[(1S)-1-[9-[[(2S)-2-[(4-hydroxy-4-oxo-butanoyl)amino]-3-methyl-pentanoyl]amino]nonylcarbamoyl]-2-methyl-butyl]amino]-4-oxo-butanoic acid |
| 4-[[(1S)-1-[10-[[(2S)-2-[(4-hydroxy-4-oxo-butanoyl)amino]-3-methyl-pentanoyl]amino]decylcarbamoyl]-2-methyl-butyl]amino]-4-oxo-butanoic acid | 4-[[(1S)-1-[11-[[(2S)-2-[(4-hydroxy-4-oxo-butanoyl)amino]-3-methyl-pentanoyl]amino]undecylcarbamoyl]-2-methyl-butyl]amino]-4-oxo-butanoic acid |
| 4-[[(1S)-1-[12-[[(2S)-2-[(4-hydroxy-4-oxo-butanoyl)amino]-3-methyl-pentanoyl]amino]dodecylcarbamoyl]-2-methyl-butyl]amino]-4-oxo-butanoic acid | |

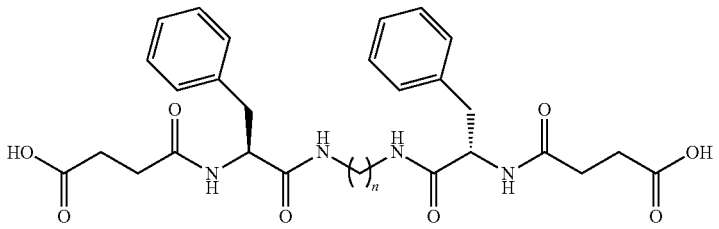

| | |
|---|---|
| 4-[[(1S)-1-benzyl-2-[2-[[(2S)-2-[(4-hydroxy-4-oxo-butanoyl)amino]-3-phenyl-propanoyl]amino]ethylamino]-2-oxo-ethyl]amino]-4-oxo-butanoic acid | 4-[[(1S)-1-benzyl-2-[3-[[(2S)-2-[(4-hydroxy-4-oxo-butanoyl)amino]-3-phenyl-propanoyl]amino]propylamino]-2-oxo-ethyl]amino]-4-oxo-butanoic acid |
| 4-[[(1S)-1-benzyl-2-[4-[[(2S)-2-[(4-hydroxy-4-oxo-butanoyl)amino]-3-phenyl-propanoyl]amino]butylamino]-2-oxo-ethyl]amino]-4-oxo-butanoic acid | 4-[[(1S)-1-benzyl-2-[5-[[(2S)-2-[(4-hydroxy-4-oxo-butanoyl)amino]-3-phenyl-propanoyl]amino]pentylamino]-2-oxo-ethyl]amino]-4-oxo-butanoic acid |
| 4-[[(1S)-1-benzyl-2-[6-[[(2S)-2-[(4-hydroxy-4-oxo-butanoyl)amino]-3-phenyl-propanoyl]amino]hexylamino]-2-oxo-ethyl]amino]-4-oxo-butanoic acid | 4-[[(1S)-1-benzyl-2-[7-[[(2S)-2-[(4-hydroxy-4-oxo-butanoyl)amino]-3-phenyl-propanoyl]amino]heptylamino]-2-oxo-ethyl]amino]-4-oxo-butanoic acid |
| 4-[[(1S)-1-benzyl-2-[8-[[(2S)-2-[(4-hydroxy- | 4-[[(1S)-1-benzyl-2-[9-[[(2S)-2-[(4-hydroxy- |

TABLE 1-continued

| | |
|---|---|
| 4-oxo-butanoyl)amino]-3-phenyl-propanoyl]amino]octylamino]-2-oxo-ethyl]amino]-4-oxo-butanoic acid | 4-oxo-butanoyl)amino]-3-phenyl-propanoyl]amino]nonylamino]-2-oxo-ethyl]amino]-4-oxo-butanoic acid |
| 4-[[(1S)-1-benzyl-2-[10-[[(2S)-2-[(4-hydroxy-4-oxo-butanoyl)amino]-3-phenyl-propanoyl]amino]decylamino]-2-oxo-ethyl]amino]-4-oxo-butanoic acid | 4-[[(1S)-1-benzyl-2-[11-[[(2S)-2-[(4-hydroxy-4-oxo-butanoyl)amino]-3-phenyl-propanoyl]amino]undecylamino]-2-oxo-ethyl]amino]-4-oxo-butanoic acid |
| 4-[[(1S)-1-benzyl-2-[12-[[(2S)-2-[(4-hydroxy-4-oxo-butanoyl)amino]-3-phenyl-propanoyl]amino]dodecylamino]-2-oxo-ethyl]amino]-4-oxo-butanoic acid | |

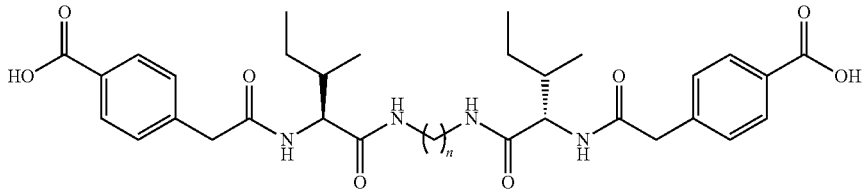

| | |
|---|---|
| 4-[2-[[(1S)-1-[2-[[(2S)-2-[[2-(4-carboxyphenyl)acetyl]amino]-3-methyl-pentanoyl]amino]ethylcarbamoyl]-2-methyl-butyl]amino]-2-oxo-ethyl]benzoic acid | 4-[2-[[(1S)-1-[3-[[(2S)-2-[[2-(4-carboxyphenyl)acetyl]amino]-3-methyl-pentanoyl]amino]propylcarbamoyl]-2-methyl-butyl]amino]-2-oxo-ethyl]benzoic acid |
| 4-[2-[[(1S)-1-[4-[[(2S)-2-[[2-(4-carboxyphenyl)acetyl]amino]-3-methyl-pentanoyl]amino]buylcarbamoyl]-2-methyl-butyl]amino]-2-oxo-ethyl]benzoic acid | 4-[2-[[(1S)-1-[5-[[(2S)-2-[[2-(4-carboxyphenyl)acetyl]amino]-3-methyl-pentanoyl]amino]pentylcarbamoyl]-2-methyl-butyl]amino]-2-oxo-ethyl]benzoic acid |
| 4-[2-[[(1S)-1-[6-[[(2S)-2-[[2-(4-carboxyphenyl)acetyl]amino]-3-methyl-pentanoyl]amino]hexylcarbamoyl]-2-methyl-butyl]amino]-2-oxo-ethyl]benzoic acid | 4-[2-[[(1S)-1-[7-[[(2S)-2-[[2-(4-carboxyphenyl)acetyl]amino]-3-methyl-pentanoyl]amino]heptylcarbamoyl]-2-methyl-butyl]amino]-2-oxo-ethyl]benzoic acid |
| 4-[2-[[(1S)-1-[8-[[(2S)-2-[[2-(4-carboxyphenyl)acetyl]amino]-3-methyl-pentanoyl]amino]octylcarbamoyl]-2-methyl-butyl]amino]-2-oxo-ethyl]benzoic acid | 4-[2-[[(1S)-1-[9-[[(2S)-2-[[2-(4-carboxyphenyl)acetyl]amino]-3-methyl-pentanoyl]amino]nonylcarbamoyl]-2-methyl-butyl]amino]-2-oxo-ethyl]benzoic acid |
| 4-[2-[[(1S)-1-[10-[[(2S)-2-[[2-(4-carboxyphenyl)acetyl]amino]-3-methyl-pentanoyl]amino]decylcarbamoyl]-2-methyl-butyl]amino]-2-oxo-ethyl]benzoic acid | 4-[2-[[(1S)-1-[11-[[(2S)-2-[[2-(4-carboxyphenyl)acetyl]amino]-3-methyl-pentanoyl]amino]undecylcarbamoyl]-2-methyl-butyl]amino]-2-oxo-ethyl]benzoic acid |
| 4-[2-[[(1S)-1-[12-[[(2S)-2-[[2-(4-carboxyphenyl)acetyl]amino]-3-methyl-pentanoyl]amino]dodecylcarbamoyl]-2-methyl-butyl]amino]-2-oxo-ethyl]benzoic acid | |

Secondary External Structurants

In one embodiment, the pH tuneable di-amido gellant may be combined with from 0.01 to 5% by weight of one or more additional external structurants. Without being limited by theory, it is believed that the use of an additional external structurant permits improved control of the time-dependent gelling. For example, while the pH tuneable di-amido gellant provides ultimately superior gelling, other external structurants may provide a temporary gel structure while the pH tuneable di-amido gellant is still undergoing gelling. Non-limiting examples of suitable secondary structurants are:

(i) Bacterial Cellulose

The fluid fabric enhancer composition may additionally comprise from 0.005% to 1.0% by weight of a bacterial cellulose network. The term "bacterial cellulose" encompasses any type of cellulose produced via fermentation of a bacteria of the genus *Acetobacter* such as CELLULON® by CPKelco U.S. and includes materials referred to popularly as microfibrillated cellulose, reticulated bacterial cellulose, and the like. Other examples of suitable bacterial cellulose can be found in U.S. Pat. Nos. 6,967,027; 5,207,826; 4,487,634; 4,373,702; 4,863,565 and US 2007/0027108. In one aspect, the fibres have cross sectional dimensions of 1.6 nm to 3.2 nm by 5.8 nm to 133 nm. Additionally, the bacterial cellulose fibres have an average microfibre length of at least 100 nm, or even from 100 to 1500 nm. In one aspect, the bacterial cellulose microfibres have an aspect ratio, meaning the average microfibre length divided by the widest cross sectional microfibre width, of from 100:1 to 400:1, or even from 200:1 to 300:1.

(ii) Coated Bacterial Cellulose

In one aspect, the bacterial cellulose is at least partially coated with a polymeric thickener. The at least partially coated bacterial cellulose can be prepared in accordance with the methods disclosed in US 2007/0027108 paragraphs 8 to 19. In one embodiment the at least partially coated bacterial cellulose comprises from 0.1% to 5%, from 0.5% to 3.0%, by weight of bacterial cellulose; and from 10% to 90% by weight of the polymeric thickener. Suitable bacterial cellulose may include the bacterial cellulose described above and suitable polymeric thickeners include: carboxymethylcellulose, cationic hydroxymethylcellulose, and mixtures thereof.

(iii) Non-Polymeric Crystalline Hydroxyl-Functional Materials

In one aspect, the fluid fabric enhancer composition further comprises from 0.01 to 1% by weight of the composition of a non-polymeric crystalline, hydroxyl functional structurant. Such non-polymeric crystalline, hydroxyl functional structurants generally may comprise a crystallizable glyceride which can be pre-emulsified to aid dispersion into the final fluid detergent composition. In one aspect, crystallizable glycerides may include hydrogenated castor oil or "HCO" or derivatives thereof, provided that it is capable of crystallizing in the liquid detergent composition.

(iv) Polymeric Structuring Agents

Fluid fabric enhancer compositions of the present invention may comprise from 0.01 to 5% by weight of a naturally derived and/or synthetic polymeric structurant. In one aspect, said naturally derived polymeric structurants may comprise hydroxyethyl cellulose, hydrophobically modified hydroxyethyl cellulose, carboxymethyl cellulose, polysaccharide derivatives and mixtures thereof. In one aspect, said polysaccharide derivatives may comprise pectine, alginate, arabinogalactan (gum Arabic), carrageenan, gellan gum, xanthan gum, guar gum and mixtures thereof. In one aspect, said synthetic polymeric structurants may comprise polycarboxylates, polyacrylates, hydrophobically modified ethoxylated urethanes, hydrophobically modified non-ionic polyols and mixtures thereof. In one aspect, said polycarboxylate polymer may comprise a polyacrylate, polymethacrylate or mixtures thereof. In one aspect, said polyacrylate is a copolymer of unsaturated mono- or di-carbonic acid and $C_1$-$C_{30}$ alkyl ester of the (meth)acrylic acid. Such copolymers are available from Noveon inc under the tradename Carbopol Aqua 30.

Water and/or Non-Aminofunctional Organic Solvent:

The fluid fabric enhancer compositions may be diluted or concentrated aqueous liquids. In one aspect, the fluid fabric enhancer composition may be almost entirely non-aqueous, and comprising a non-aminofunctional organic solvent. Such fluid fabric enhancer compositions may comprise very little water, for instance, that may be introduced with other raw materials.

In one aspect, the fluid fabric enhancer composition comprises from 1% to 95% by weight of water and/or non-aminofunctional organic solvent. In one aspect, concentrated fluid fabric enhancer compositions may comprise from about 5% to about 85%, or from about 10% to about 50%, or even from about 15% to about 45% by weight, water and/or non-aminofunctional organic solvent.

In one aspect, said non-aminofunctional organic solvents include monohydric alcohols, dihydric alcohols, polyhydric alcohols, glycerol, glycols, polyalkylene glycols such as polyethylene glycol, and mixtures thereof. In one aspect, mixtures of "non-aminofunctional organic solvent" may be used, especially mixtures of two or more of the following: lower aliphatic alcohols such as ethanol, propanol, butanol, isopropanol; diols such as 1,2-propanediol or 1,3-propanediol; and glycerol. In one aspect, said "non-aminofunctional organic solvents" are liquid at ambient temperature and pressure (i.e. 21° C. and 1 atmosphere), and may comprise carbon, hydrogen and oxygen.

Suitable Fabric Softening Actives

The fluid fabric enhancer compositions disclosed herein comprise a fabric softening active ("FSA"). Suitable fabric softening actives, include, but are not limited to, materials selected from the group consisting of quats, amines, fatty esters, sucrose esters, silicones, dispersible polyolefins, clays, polysaccharides, fatty acids, softening oils, polymer latexes and mixtures thereof.

Non-limiting examples of water insoluble fabric care benefit agents include dispersible polyethylene and polymer latexes. These agents can be in the form of emulsions, latexes, dispersions, suspensions, and the like. In one aspect, they are in the form of an emulsion or a latex. Dispersible polyethylenes and polymer latexes can have a wide range of particle size diameters ($\chi_{50}$) including but not limited to from about 1 nm to about 100 μm; alternatively from about 10 nm to about 10 μm. As such, the particle sizes of dispersible polyethylenes and polymer latexes are generally, but without limitation, smaller than silicones or other fatty oils.

Generally, any surfactant suitable for making polymer emulsions or emulsion polymerizations of polymer latexes can be used to make the water insoluble fabric care benefit agents of the present invention. Suitable surfactants consist of emulsifiers for polymer emulsions and latexes, dispersing agents for polymer dispersions and suspension agents for polymer suspensions. Suitable surfactants include anionic, cationic, and nonionic surfactants, or combinations thereof. In one aspect, such surfactants are nonionic and/or anionic surfactants. In one aspect, the ratio of surfactant to polymer in the water insoluble fabric care benefit agent is about 1:100 to about 1:2; alternatively from about 1:50 to about 1:5, respectively. Suitable water insoluble fabric care benefit agents include but are not limited to the examples described below.

Quat—Suitable quats include but are not limited to, materials selected from the group consisting of ester quats, amide quats, imidazoline quats, alkyl quats, amdioester quats and mixtures thereof. Suitable ester quats include but are not limited to, materials selected from the group consisting of monoester quats, diester quats, triester quats and mixtures thereof. In one aspect, a suitable ester quat is bis-(2-hydroxypropyl)-dimethylammonium methylsulphate fatty acid ester having a molar ratio of fatty acid moieties to amine moieties of from 1.85 to 1.99, an average chain length of the fatty acid moieties of from 16 to 18 carbon atoms and an iodine value of the fatty acid moieties, calculated for the free fatty acid, of from 0.5 to 60 or 15 to 50. In one aspect, the cis-trans-ratio of double bonds of unsaturated fatty acid moieties of the bis(2 hydroxypropyl)-dimethylammonium methylsulphate fatty acid ester is from 55:45 to 75:25, respectively. Suitable amide quats include but are not limited to, materials selected from the group consisting of monoamide quats, diamide quats and mixtures thereof. Suitable alkyl quats include but are not limited to, materials selected from the group consisting of mono alkyl quats, dialkyl quats quats, trialkyl quats, tetraalkyl quats and mixtures thereof.

Amines—Suitable amines include but are not limited to, materials selected from the group consisting of esteramines, amidoamines, imidazoline amines, alkyl amines, amdioester amines and mixtures thereof. Suitable ester amines include but are not limited to, materials selected from the group consisting of monoester amines, diester amines, triester amines and mixtures thereof. Suitable amido quats include but are not limited to, materials selected from the group consisting of monoamido amines, diamido amines and mixtures thereof. Suitable alkyl amines include but are not limited to, materials selected from the group consisting of mono alkylamines, dialkyl amines quats, trialkyl amines, and mixtures thereof.

In one embodiment, the fabric softening active is a quaternary ammonium compound suitable for softening fabric in a rinse step. In one embodiment, the fabric softening active is formed from a reaction product of a fatty acid and an aminoalcohol obtaining mixtures of mono-, di-, and, in one embodiment, tri-ester compounds. In another embodiment, the fabric softening active comprises one or more softener quaternary ammonium compounds such, but not limited to, as a monoalkyquaternary ammonium compound, dialkylquaternary ammonium compound, a diamido quaternary compound, a diester quaternary ammonium compound, or a combination thereof.

In one aspect, the fabric softening active comprises a diester quaternary ammonium or protonated diester ammonium (hereinafter "DQA") compound composition. In certain embodiments of the present invention, the DQA compound compositions also encompass diamido fabric softening actives s and fabric softening actives with mixed amido and ester linkages as well as the aforementioned diester linkages, all herein referred to as DQA.

In one aspect, said fabric softening active may comprise, as the principal active, compounds of the following formula:

$$\{R_{4-m}—N^+—[X—Y—R^1]_m\}X^- \quad (1)$$

wherein each R comprises either hydrogen, a short chain $C_1$-$C_6$, in one aspect a $C_1$-$C_3$ alkyl or hydroxyalkyl group, for example methyl, ethyl, propyl, hydroxyethyl, and the like, poly($C_{2-3}$ alkoxy), polyethoxy, benzyl, or mixtures thereof; each X is independently $(CH_2)n$, $CH_2$—$CH(CH_3)$— or CH—$(CH_3)$—$CH_2$—; each Y may comprise —O—(O)C—, —C(O)—O—, —NR—C(O)—, or —C(O)—NR—; each m is 2 or 3; each n is from 1 to about 4, in one aspect 2; the sum of carbons in each $R^1$, plus one when Y is —O—(O)C— or —NR—C(O)—, may be $C_{12}$-$C_{22}$, or $C_{14}$-$C_{20}$, with each $R^1$ being a hydrocarbyl, or substituted hydrocarbyl group; and $X^-$ may comprise any softener-compatible anion. In one aspect, the softener-compatible anion may comprise chloride, bromide, methylsulfate, ethylsulfate, sulfate, and nitrate. In another aspect, the softener-compatible anion may comprise chloride or methyl sulfate.

In another aspect, the fabric softening active may comprise the general formula:

$$[R_3N^+CH_2CH(YR^1)(CH_2YR^1)]X^-$$

wherein each Y, R, $R^1$, and $X^-$ have the same meanings as before. Such compounds include those having the formula:

$$[CH_3]_3N^{(+)}[CH_2CH(CH_2O(O)CR^1)O(O)CR^1]C1^{(-)} \quad (2)$$

wherein each R may comprise a methyl or ethyl group. In one aspect, each $R^1$ may comprise a $C_{15}$ to $C_{19}$ group. As used herein, when the diester is specified, it can include the monoester that is present.

These types of agents and general methods of making them are disclosed in U.S. Pat. No. 4,137,180. An example of a suitable DEQA (2) is the "propyl" ester quaternary ammonium fabric softener active comprising the formula 1,2-di (acyloxy)-3-trimethylammoniopropane chloride.

A third type of useful fabric softening active has the formula:

$$[R_{4-m}—N^+—R^1{}_m]X^- \quad (3)$$

wherein each R, $R^1$, m and $X^-$ have the same meanings as before.

In a further aspect, the fabric softening active may comprise the formula:

(4)

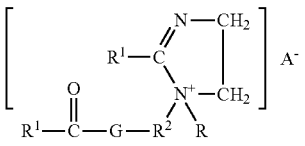

wherein each R, $R^1$, and $A^-$ have the definitions given above; $R^2$ may comprise a $C_{1-6}$ alkylene group, in one aspect an ethylene group; and G may comprise an oxygen atom or an —NR— group;

In a yet further aspect, the fabric softening active may comprise the formula:

(5)

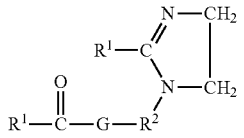

wherein $R^1$, $R^2$ and G are defined as above.

In a further aspect, the fabric softening active may comprise condensation reaction products of fatty acids with dialkylenetriamines in, e.g., a molecular ratio of about 2:1, said reaction products containing compounds of the formula:

$$R^1—C(O)—NH—R^2—NH—R^3—NH—C(O)—R^1 \quad (6)$$

wherein $R^1$, $R^2$ are defined as above, and $R^3$ may comprise a $C_{1-6}$ alkylene group, in one aspect, an ethylene group and wherein the reaction products may optionally be quaternized by the additional of an alkylating agent such as dimethyl sulfate. Such quaternized reaction products are described in additional detail in U.S. Pat. No. 5,296,622.

In a yet further aspect, the fabric softening active may comprise the formula:

$$[R^1—C(O)—NR—R^2—N(R)_2—R^3—NR—C(O)—R^1]^+A^- \quad (7)$$

wherein R, $R^1$, $R^2$, $R^3$ and $A^-$ are defined as above;

In a yet further aspect, the fabric softening active may comprise reaction products of fatty acid with hydroxyalkylalkylenediamines in a molecular ratio of about 2:1, said reaction products containing compounds of the formula:

$$R^1—C(O)—NH—R^2—N(R^3OH)—C(O)—R^1 \quad (8)$$

wherein $R^1$, $R^2$ and $R^3$ are defined as above;

In a yet further aspect, the fabric softening active may comprise the formula:

(9)

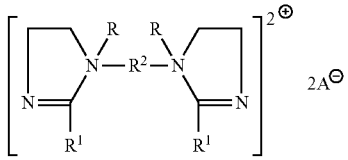

wherein R, $R^1$, $R^2$, and $A^-$ are defined as above.

In yet a further aspect, the fabric softening active may comprise the formula (10);

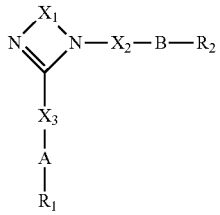

wherein;

$X_1$ is a $C_{2-3}$ alkyl group, in one aspect, an ethyl group;

$X_2$ and $X_3$ are independently $C_{1-6}$ linear or branched alkyl or alkenyl groups, in one aspect, methyl, ethyl or isopropyl groups;

$R_1$ and $R_2$ are independently $C_{8-22}$ linear or branched alkyl or alkenyl groups; characterized in that;

A and B are independently selected from the group comprising —O—(C═O)—, —(C═O)—O—, or mixtures thereof, in one aspect, —O—(C═O)—

Non-limiting examples of fabric softening actives comprising formula (1) are N,N-bis(stearoyl-oxy-ethyl) N,N-dimethyl ammonium chloride, N,N-bis(tallowoyl-oxy-ethyl) N,N-dimethyl ammonium chloride, N,N-bis(stearoyl-oxy-ethyl) N-(2 hydroxyethyl) N-methyl ammonium methylsulfate.

Non-limiting examples of fabric softening actives comprising formula (2) is 1, 2 di(stearoyl-oxy) 3 trimethyl ammoniumpropane chloride.

Non-limiting examples of fabric softening actives comprising formula (3) include dialkylenedimethylammonium salts such as dicanoladimethylammonium chloride, di(hard) tallowedimethylammonium chloride dicanoladimethylammonium methylsulfate, and mixtures thereof. An example of commercially available dialkylenedimethylammonium salts usable in the present invention is dioleyldimethylammonium chloride available from Witco Corporation under the trade name Adogen® 472 and dihardtallow dimethylammonium chloride available from Akzo Nobel Arquad 2HT75.

A non-limiting example of fabric softening actives comprising formula (4) is 1-methyl-1-stearoylamidoethyl-2-stearoylimidazolinium methylsulfate wherein $R^1$ is an acyclic aliphatic $C_{15}$-$C_{17}$ hydrocarbon group, $R^2$ is an ethylene group, G is a NH group, $R^5$ is a methyl group and $A^-$ is a methyl sulfate anion, available commercially from the Witco Corporation under the trade name Varisoft®.

A non-limiting example of fabric softening actives comprising formula (5) is 1-tallowylamidoethyl-2-tallowylimidazoline wherein $R^1$ is an acyclic aliphatic $C_{15}$-$C_{17}$ hydrocarbon group, $R^2$ is an ethylene group, and G is a NH group.

A non-limiting example of a fabric softening active comprising formula (6) is the reaction products of fatty acids with diethylenetriamine in a molecular ratio of about 2:1, said reaction product mixture containing N,N"-dialkyldiethylenetriamine with the formula:

$$R^1—C(O)—NH—CH_2CH_2—NH—CH_2CH_2—NH—C(O)—R^1$$

wherein $R^1$ is an alkyl group of a commercially available fatty acid derived from a vegetable or animal source, such as Emersol® 223LL or Emersol® 7021, available from Henkel Corporation, and $R^2$ and $R^3$ are divalent ethylene groups.

A non-limiting example of Compound (7) is a di-fatty amidoamine based softener having the formula:

$$[R^1—C(O)—NH—CH_2CH_2—N(CH_3)(CH_2CH_2OH)—CH_2CH_2—NH—C(O)—R^1]^+ CH_3SO_4^-$$

wherein $R^1$ is an alkyl group. An example of such compound is that commercially available from the Witco Corporation e.g. under the trade name Varisoft® 222LT.

An example of a fabric softening active comprising formula (8) is the reaction products of fatty acids with N-2-hydroxyethylethylenediamine in a molecular ratio of about 2:1, said reaction product mixture containing a compound of the formula:

$$R^1—C(O)—NH—CH_2CH_2—N(CH_2CH_2OH)—C(O)—R^1$$

wherein $R^1$—C(O) is an alkyl group of a commercially available fatty acid derived from a vegetable or animal source, such as Emersol® 223LL or Emersol® 7021, available from Henkel Corporation.

An example of a fabric softening active comprising formula (9) is the diquaternary compound having the formula:

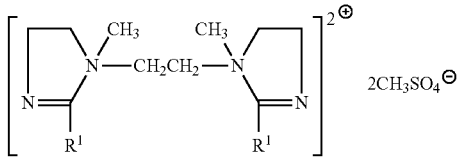

wherein $R^1$ is derived from fatty acid. Such compound is available from Witco Company.

A non-limiting example of a fabric softening active comprising formula (10) is a dialkyl imidazoline diester compound, where the compound is the reaction product of N-(2-hydroxyethyl)-1,2-ethylenediamine or N-(2-hydroxyisopropyl)-1,2-ethylenediamine with glycolic acid, esterified with fatty acid, where the fatty acid is (hydrogenated) tallow fatty acid, palm fatty acid, hydrogenated palm fatty acid, oleic acid, rapeseed fatty acid, hydrogenated rapeseed fatty acid or a mixture of the above.

It will be understood that combinations of softener actives disclosed above are suitable for use in this invention.

Anion A

In the cationic nitrogenous salts herein, the anion $A^-$, which comprises any softener compatible anion, provides electrical neutrality. Most often, the anion used to provide electrical neutrality in these salts is from a strong acid, especially a halide, such as chloride, bromide, or iodide. However, other anions can be used, such as methylsulfate, ethylsulfate, acetate, formate, sulfate, carbonate, and the like. In one aspect, the anion A may comprise chloride or methylsulfate. The anion, in some aspects, may carry a double charge. In this aspect, $A^-$ represents half a group.

In one embodiment, the fabric softening agent comprises an fabric softening agent described in U.S. Pat. Pub. No. 2004/0204337 A1, published Oct. 14, 2004 to Corona et al., from paragraphs 30-79.

In another embodiment, the fabric softening agent is one described in U.S. Pat. Pub. No. 2004/0229769 A1, published Nov. 18, 2005, to Smith et al., on paragraphs 26-31; or U.S. Pat. No. 6,494,920, at column 1, line 51 et seq. detailing an "esterquat" or a quaternized fatty acid triethanolamine ester salt.

In one embodiment, the fabric softening agent is chosen from at least one of the following: ditallowoyloxyethyl dimethyl ammonium chloride, dihydrogenated-tallowoyloxyethyl dimethyl ammonium chloride, ditallow dimethyl ammonium chloride, dihydrogenatedtallow dimethyl ammonium chloride, ditallowoyloxyethyl methylhydroxyethylammonium methyl sulfate, dihydrogenated-tallowoyloxyethyl methyl hydroxyethylammonium chloride, or combinations thereof.

Polyssacharides

One aspect of the invention provides a fabric enhancer composition comprising a cationic starch as a fabric softening active. In one embodiment, the fabric care compositions of the present invention generally comprise cationic starch at a level of from about 0.1% to about 7%, alternatively from about 0.1% to about 5%, alternatively from about 0.3% to about 3%, and alternatively from about 0.5% to about 2.0%, by weight of the composition. Cationic starch as a fabric softening active is described in U.S. Pat. Pub. 2004/0204337 A1, published Oct. 14, 2004, to Corona et al., at paragraphs 16-32. Suitable cationic starches for use in the present compositions are commercially-available from Cerestar under the trade name C*BOND® and from National Starch and Chemical Company under the trade name CATO® 2A.

Silicone

In one embodiment, the fabric softening composition comprises a silicone. Suitable levels of silicone may comprise from about 0.1% to about 70%, alternatively from about 0.3% to about 40%, alternatively from about 0.5% to about 30%, alternatively from about 1% to about 20% by weight of the composition. Useful silicones can be any silicone comprising compound. In one embodiment, the silicone is a polydialkylsilicone, alternatively a polydimethyl silicone (polydimethyl siloxane or "PDMS"), or a derivative thereof. In another embodiment, the silicone is chosen from an aminofunctional silicone, amino-polyether silicone, alkyloxylated silicone, cationic silicone, ethoxylated silicone, propoxylated silicone, ethoxylated/propoxylated silicone, quaternary silicone, or combinations thereof. Other useful silicone materials may include materials of the formula:

$$HO[Si(CH_3)_2—O]_x\{Si(OH)[(CH_2)_3—NH—(CH_2)_2—NH_2]O\}_yH$$

wherein x and y are integers which depend on the molecular weight of the silicone, in one aspect, such silicone has a molecular weight such that the silicone exhibits a viscosity of from about 500 cSt to about 500,000 cSt at 25° C. This material is also known as "amodimethicone".

In another embodiment, the silicone may be chosen from a random or blocky organosilicone polymer having the following formula:

$$[R_1R_2R_3SiO_{1/2}]_{(j+2)}[(R_4Si(X—Z)O_{2/2}]_k[R_4R_4SiO_{2/2}]_m[R_4SiO_{3/2}]_j$$

wherein:

j is an integer from 0 to about 98; in one aspect j is an integer from 0 to about 48; in one aspect, j is 0;

k is an integer from 0 to about 200, in one aspect k is an integer from 0 to about 50; when k=0, at least one of $R_1$, $R_2$ or $R_3$ is —X—Z;

m is an integer from 4 to about 5,000; in one aspect m is an integer from about 10 to about 4,000; in another aspect m is an integer from about 50 to about 2,000;

$R_1$, $R_2$ and $R_3$ are each independently selected from the group consisting of H, OH, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, $C_1$-$C_{32}$ alkoxy, $C_1$-$C_{32}$ substituted alkoxy and X—Z;

each $R_4$ is independently selected from the group consisting of H, OH, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, $C_1$-$C_{32}$ alkoxy and $C_1$-$C_{32}$ substituted alkoxy;

each X in said alkyl siloxane polymer comprises a substituted or unsubsitituted divalent alkylene radical comprising 2-12 carbon atoms, in one aspect each divalent alkylene radical is independently selected from the group consisting of —$(CH_2)_s$— wherein s is an integer from about 2 to about 8, from about 2 to about 4; in one aspect, each X in said alkyl siloxane polymer comprises a substituted divalent alkylene radical selected from the group consisting of: —$CH_2$—CH(OH)—$CH_2$—; —$CH_2$—$CH_2$—CH(OH)—; and

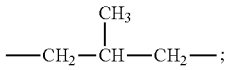

each Z is selected independently from the group consisting of

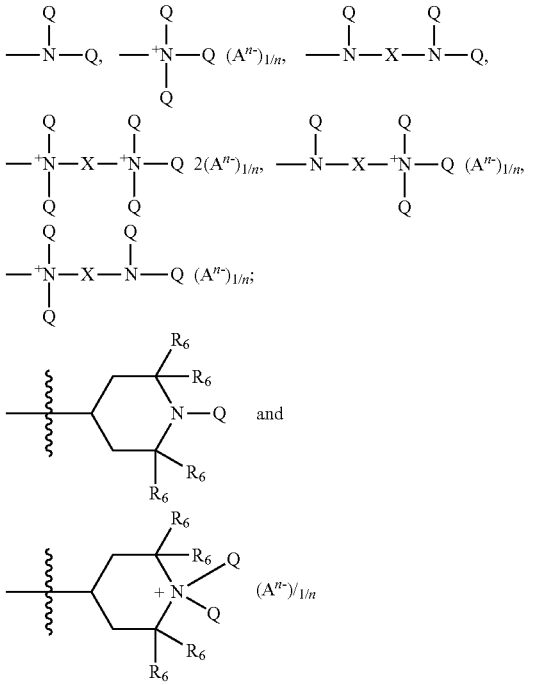

with the proviso that when Z is a quat, Q cannot be an amide, imine, or urea moiety and if Q is an amide, imine, or urea moiety, then any additional Q bonded to the same nitrogen as said amide, imine, or urea moiety must be H or a $C_1$-$C_6$ alkyl, in one aspect, said additional Q is H; for Z $A^{n-}$ is a suitable charge balancing anion. In one aspect $A^{n-}$ is selected from the group consisting of $Cl^-$, $Br^-$, $I^-$, methylsulfate, toluene sulfonate, carboxylate and phosphate; and at least one Q in said organosilicone is independently selected from —$CH_2$—CH(OH)—$CH_2$—$R_5$;

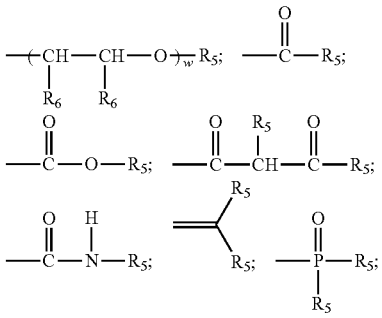

-continued

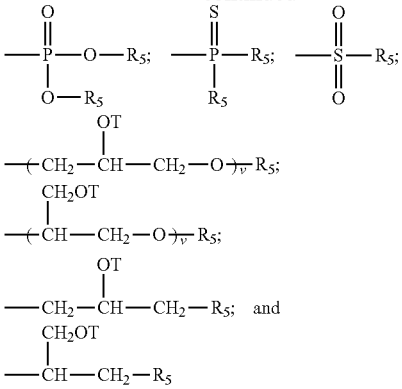

each additional Q in said organosilicone is independently selected from the group comprising of H, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, —$CH_2$—CH(OH)—$CH_2$—$R_5$;

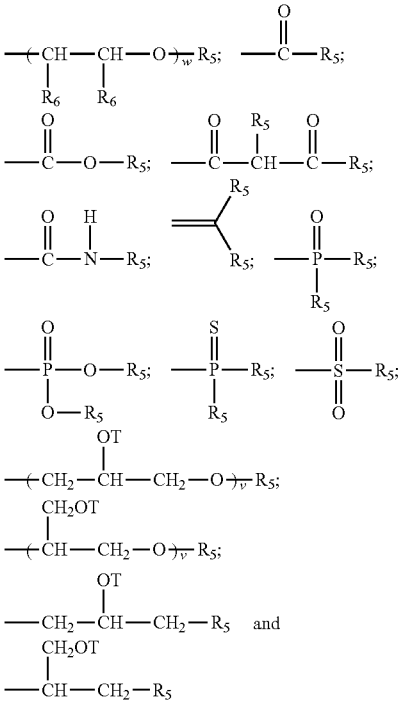

wherein each $R_5$ is independently selected from the group consisting of H, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, —($CHR_6$—$CHR_6$—O—)$_w$L and a siloxyl residue;

each $R_6$ is independently selected from H, $C_1$-$C_{18}$ alkyl each L is independently selected from —C(O)—$R_7$ or $R_7$;

W is an integer from 0 to about 500, in one aspect w is an integer from about 1 to about 200; in one aspect w is an integer from about 1 to about 50;

each $R_7$ is selected independently from the group consisting of H; $C_1$-$C_{32}$ alkyl; $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl; $C_6$-$C_{32}$ substituted alkylaryl and a siloxyl residue;

each T is independently selected from H, and

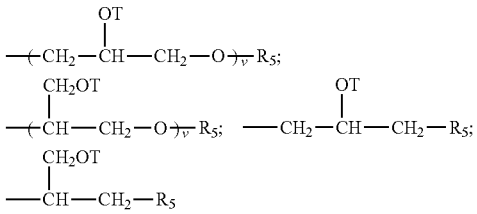

and wherein each v in said organosilicone is an integer from 1 to about 10, in one aspect, v is an integer from 1 to about 5 and the sum of all v indices in each Q in the said organosilicone is an integer from 1 to about 30 or from 1 to about 20 or even from 1 to about 10.

In another embodiment, the silicone may be chosen from a random or blocky organosilicone polymer having the following formula:

$$[R_1R_2R_3SiO_{1/2}]_{(j+2)}[(R_4Si(X—Z)O_{2/2}]_k[R_4R_4SiO_{2/2}]_m[R_4SiO_{3/2}]_j$$

wherein j is an integer from 0 to about 98; in one aspect j is an integer from 0 to about 48; in one aspect, j is 0;

k is an integer from 0 to about 200; when k=0, at least one of $R_1$, $R_2$ or $R_3$=—X—Z, in one aspect, k is an integer from 0 to about 50 m is an integer from 4 to about 5,000; in one aspect m is an integer from about 10 to about 4,000; in another aspect m is an integer from about 50 to about 2,000;

$R_1$, $R_2$ and $R_3$ are each independently selected from the group consisting of H, OH, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, $C_1$-$C_{32}$ alkoxy, $C_1$-$C_{32}$ substituted alkoxy and X—Z;

each $R_4$ is independently selected from the group consisting of H, OH, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, $C_1$-$C_{32}$ alkoxy and $C_1$-$C_{32}$ substituted alkoxy;

each X comprises of a substituted or unsubstituted divalent alkylene radical comprising 2-12 carbon atoms; in one aspect each X is independently selected from the group consisting of —$(CH_2)_s$—O—; —$CH_2$—CH(OH)—$CH_2$—O—;

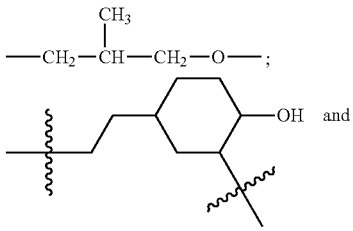

and

-continued

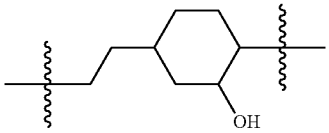

wherein each s independently is an integer from about 2 to about 8, in one aspect s is an integer from about 2 to about 4;

At least one Z in the said organosiloxane is selected from the group consisting of $R_5$;

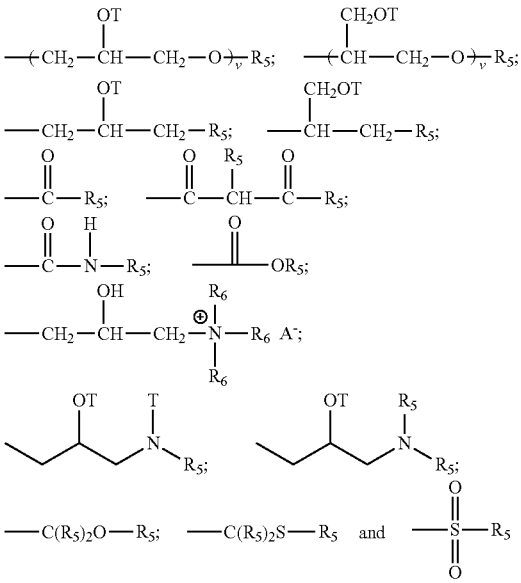

provided that when X is

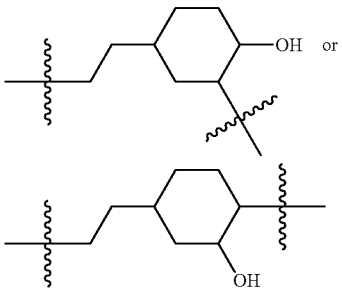

then Z=—$OR_5$ or

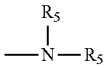

wherein $A^-$ is a suitable charge balancing anion. In one aspect $A^-$ is selected from the group consisting of $Cl^-$, $Br^-$, $I^-$, methylsulfate, toluene sulfonate, carboxylate and phosphate and each additional Z in said organosilicone is independently selected from the group comprising of H, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, $R_5$,

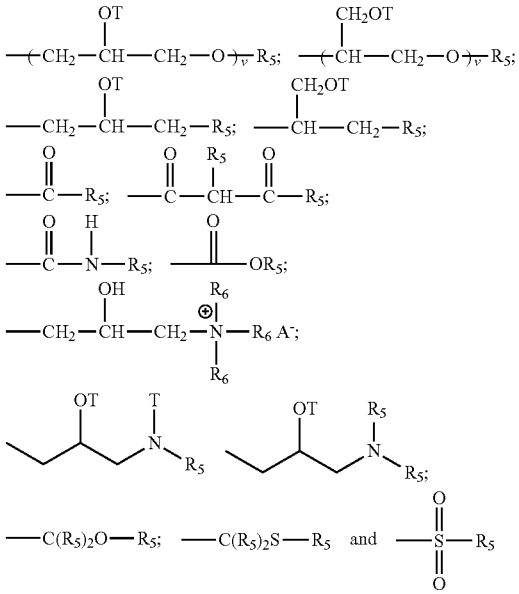

provided that when X is

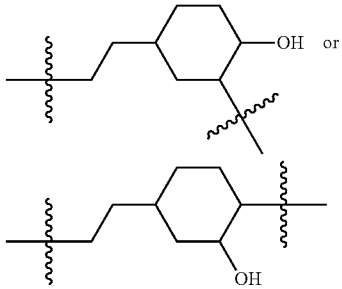

then Z=—$OR_5$ or

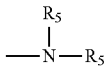

each $R_5$ is independently selected from the group consisting of H; $C_1$-$C_{32}$ alkyl; $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl or $C_6$-$C_{32}$ alkylaryl, or $C_6$-$C_{32}$ substituted alkylaryl, —$(CHR_6—CHR_6—O—)_w$—$CHR_6$—$CHR_6$—L and siloxyl residue wherein each L is independently selected from —O—C(O)—$R_7$ or —O—$R_7$;

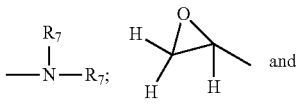

-continued

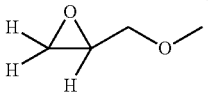

w is an integer from 0 to about 500, in one aspect w is an integer from 0 to about 200, one aspect w is an integer from 0 to about 50;

each $R_6$ is independently selected from H or $C_1$-$C_{18}$ alkyl;

each $R_7$ is independently selected from the group consisting of H; $C_1$-$C_{32}$ alkyl; $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, and $C_6$-$C_{32}$ substituted aryl, and a siloxyl residue;

each T is independently selected from H;

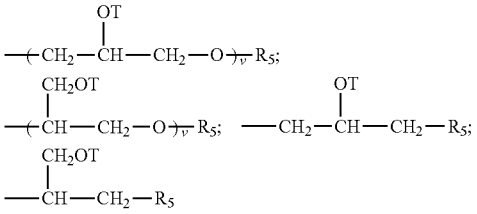

wherein each v in said organosilicone is an integer from 1 to about 10, in one aspect, v is an integer from 1 to about 5 and the sum of all v indices in each Z in the said organosilicone is an integer from 1 to about 30 or from 1 to about 20 or even from 1 to about 10.

In one embodiment, the silicone is one comprising a relatively high molecular weight. A suitable way to describe the molecular weight of a silicone includes describing its viscosity. A high molecular weight silicone is one having a viscosity of from about 10 cSt to about 3,000,000 cSt, or from about 100 cSt to about 1,000,000 cSt, or from about 1,000 cSt to about 600,000 cSt, or even from about 6,000 cSt to about 300,000 cSt, Sucrose Esters Nonionic fabric care benefit agents can comprise sucrose esters, and are typically derived from sucrose and fatty acids. Sucrose ester is composed of a sucrose moiety having one or more of its hydroxyl groups esterified.

Sucrose is a disaccharide having the following formula:

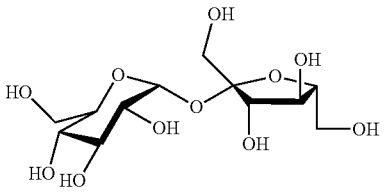

Alternatively, the sucrose molecule can be represented by the formula: $M(OH)_8$, wherein M is the disaccharide backbone and there are total of 8 hydroxyl groups in the molecule.

Thus, sucrose esters can be represented by the following formula:

$$M(OH)_{8-x}(OC(O)R^1)_x$$

wherein x is the number of hydroxyl groups that are esterified, whereas (8-x) is the hydroxyl groups that remain unchanged; x is an integer selected from 1 to 8, alternatively from 2 to 8, alternatively from 3 to 8, or from 4 to 8; and $R^1$ moieties are independently selected from $C_1$-$C_{22}$ alkyl or $C_1$-$C_{30}$ alkoxy, linear or branched, cyclic or acyclic, saturated or unsaturated, substituted or unsubstituted.

In one embodiment, the $R^1$ moieties comprise linear alkyl or alkoxy moieties having independently selected and varying chain length. For example, $R^1$ may comprise a mixture of linear alkyl or alkoxy moieties wherein greater than about 20% of the linear chains are $C_{18}$, alternatively greater than about 50% of the linear chains are $C_{18}$, alternatively greater than about 80% of the linear chains are $C_{18}$.

In another embodiment, the $R^1$ moieties comprise a mixture of saturate and unsaturated alkyl or alkoxy moieties; the degree of unsaturation can be measured by "Iodine Value" (hereinafter referred as "IV", as measured by the standard AOCS method). The IV of the sucrose esters suitable for use herein ranges from about 1 to about 150, or from about 2 to about 100, or from about 5 to about 85. The $R^1$ moieties may be hydrogenated to reduce the degree of unsaturation. In the case where a higher IV is preferred, such as from about 40 to about 95, then oleic acid and fatty acids derived from soybean oil and canola oil are the starting materials.

In a further embodiment, the unsaturated $R^1$ moieties may comprise a mixture of "cis" and "trans" forms about the unsaturated sites. The "cis"/"trans" ratios may range from about 1:1 to about 50:1, or from about 2:1 to about 40:1, or from about 3:1 to about 30:1, or from about 4:1 to about 20:1.

Dispersible Polyolefins

Generally, all dispersible polyolefins that provide fabric care benefits can be used as water insoluble fabric care benefit agents in the present invention. The polyolefins can be in the format of waxes, emulsions, dispersions or suspensions. Non-limiting examples are discussed below.

In one embodiment, the polyolefin is chosen from a polyethylene, polypropylene, or a combination thereof. The polyolefin may be at least partially modified to contain various functional groups, such as carboxyl, alkylamide, sulfonic acid or amide groups. In another embodiment, the polyolefin is at least partially carboxyl modified or, in other words, oxidized.

For ease of formulation, the dispersible polyolefin may be introduced as a suspension or an emulsion of polyolefin dispersed by use of an emulsifying agent. The polyolefin suspension or emulsion may comprise from about 1% to about 60%, alternatively from about 10% to about 55%, alternatively from about 20% to about 50% by weight of polyolefin. The polyolefin may have a wax dropping point (see ASTM D3954-94, volume 15.04- - - "Standard Test Method for Dropping Point of Waxes") from about 20° to about 170° C., alternatively from about 50° to about 140° C. Suitable polyethylene waxes are available commercially from suppliers including but not limited to Honeywell (A-C polyethylene), Clariant (Velustrol® emulsion), and BASF (LUWAX®).

When an emulsion is employed with the dispersible polyolefin, the emulsifier may be any suitable emulsification agent. Non-limiting examples include an anionic, cationic, nonionic surfactant, or a combination thereof. However, almost any suitable surfactant or suspending agent may be employed as the emulsification agent. The dispersible polyolefin is dispersed by use of an emulsification agent in a ratio to polyolefin wax of about 1:100 to about 1:2, alternatively from about 1:50 to about 1:5, respectively.

Polymer Latexes

Polymer latex is made by an emulsion polymerization which includes one or more monomers, one or more emulsifiers, an initiator, and other components familiar to those of ordinary skill in the art. Generally, all polymer latexes that provide fabric care benefits can be used as water insoluble fabric care benefit agents of the present invention. Non-limiting examples of suitable polymer latexes include those disclosed in US 2004/0038851 A1; and US 2004/0065208 A1. Additional non-limiting examples include the monomers used in producing polymer latexes such as: (1) 100% or pure butylacrylate; (2) butylacrylate and butadiene mixtures with at least 20% (weight monomer ratio) of butylacrylate; (3) butylacrylate and less than 20% (weight monomer ratio) of other monomers excluding butadiene; (4) alkylacrylate with an alkyl carbon chain at or greater than $C_6$; (5) alkylacrylate with an alkyl carbon chain at or greater than $C_6$ and less than 50% (weight monomer ratio) of other monomers; (6) a third monomer (less than 20% weight monomer ratio) added into an aforementioned monomer systems; and (7) combinations thereof.

Polymer latexes that are suitable fabric care benefit agents in the present invention may include those having a glass transition temperature of from about −120° C. to about 120° C., alternatively from about −80° C. to about 60° C. Suitable emulsifiers include anionic, cationic, nonionic and amphoteric surfactants. Suitable initiators include initiators that are suitable for emulsion polymerization of polymer latexes. The particle size diameter ($\chi_{50}$) of the polymer latexes can be from about 1 nm to about 10 μm, alternatively from about 10 nm to about 1 μm, or even from about 10 nm to about 20 nm.

Fatty Acid

One aspect of the invention provides a fabric softening composition comprising a fatty acid, such as a free fatty acid. The term "fatty acid" is used herein in the broadest sense to include unprotonated or protonated forms of a fatty acid; and includes fatty acid that is bound or unbound to another chemical moiety as well as the various combinations of these species of fatty acid. One skilled in the art will readily appreciate that the pH of an aqueous composition will dictate, in part, whether a fatty acid is protonated or unprotonated. In another embodiment, the fatty acid is in its unprotonated, or salt form, together with a counter ion, such as, but not limited to, calcium, magnesium, sodium, potassium and the like. The term "free fatty acid" means a fatty acid that is not bound (to another chemical moiety (covalently or otherwise) to another chemical moiety.

In one embodiment, the fatty acid may include those containing from about 12 to about 25, from about 13 to about 22, or even from about 16 to about 20, total carbon atoms, with the fatty moiety containing from about 10 to about 22, from about 12 to about 18, or even from about 14 (mid-cut) to about 18 carbon atoms.

The fatty acids of the present invention may be derived from (1) an animal fat, and/or a partially hydrogenated animal fat, such as beef tallow, lard, etc.; (2) a vegetable oil, and/or a partially hydrogenated vegetable oil such as canola oil, safflower oil, peanut oil, sunflower oil, sesame seed oil, rapeseed oil, cottonseed oil, corn oil, soybean oil, tall oil, rice bran oil, palm oil, palm kernel oil, coconut oil, other tropical palm oils, linseed oil, tung oil, etc.; (3) processed and/or bodied oils, such as linseed oil or tung oil via thermal, pressure, alkali-isomerization and catalytic treatments; (4) a mixture thereof, to yield saturated (e.g. stearic acid), unsaturated (e.g. oleic acid), polyunsaturated (linoleic acid), branched (e.g. isostearic acid) or cyclic (e.g. saturated or unsaturated α-disubstituted cyclopentyl or cyclohexyl derivatives of polyunsaturated acids) fatty acids. Non-limiting examples of fatty acids (FA) are listed in U.S. Pat. No. 5,759,990 at col 4, lines 45-66.

Mixtures of fatty acids from different fat sources can be used.

In one aspect, at least a majority of the fatty acid that is present in the fabric softening composition of the present invention is unsaturated, e.g., from about 40% to 100%, from about 55% to about 99%, or even from about 60% to about 98%, by weight of the total weight of the fatty acid present in the composition, although fully saturated and partially saturated fatty acids can be used. As such, the total level of polyunsaturated fatty acids (TPU) of the total fatty acid of the inventive composition may be from about 0% to about 75% by weight of the total weight of the fatty acid present in the composition.

The cis/trans ratio for the unsaturated fatty acids may be important, with the cis/trans ratio (of the C18:1 material) being from at least about 1:1, at least about 3:1, from about 4:1 or even from about 9:1 or higher.

Branched fatty acids such as isostearic acid are also suitable since they may be more stable with respect to oxidation and the resulting degradation of color and odor quality.

The Iodine Value or "IV" measures the degree of unsaturation in the fatty acid. In one embodiment of the invention, the fatty acid has an IV from about 40 to about 140, from about 50 to about 120 or even from about 85 to about 105.

Examples of fatty acids are described in WO06007911A1 and WO06007899A1

Softening Oils

Another class of optional fabric care actives is softening oils, which include but are not limited to, vegetable oils (such as soybean, sunflower, and canola), hydrocarbon based oils (natural and synthetic petroleum lubricants, in one aspect polyolefins, isoparaffins, and cyclic paraffins), triolein, fatty esters, fatty alcohols, fatty amines, fatty amides, and fatty ester amines. Oils can be combined with fatty acid softening agents, clays, and silicones.

Clays

In one embodiment of the invention, the fabric care composition may comprise a clay as a fabric care active. In one embodiment clay can be a softener or co-softeners with another softening active, for example, silicone. Suitable clays include those materials classified geologically smectites and are described in USPA No. 2003/0216274 A1. Other suitable clays are described in U.S. Patent Application Publication No. 20050020476A1 to Wahl, et. al.,.

Adjunct Materials

According to another aspect of the present invention, the fluid fabric enhancer compositions may comprise one or more of the following optional ingredients: perfume delivery systems such as encapsulated perfumes, dispersing agents, stabilizers, pH control agents, colorants, brighteners, dyes, odor control agent, cyclodextrin, solvents, soil release polymers, preservatives, antimicrobial agents, chlorine scavengers, anti-shrinkage agents, fabric crisping agents, spotting agents, anti-oxidants, anti-corrosion agents, formaldehyde scavengers as disclosed above, bodying agents, drape and form control agents, smoothness agents, static control agents, wrinkle control agents, sanitization agents, disinfecting agents, germ control agents, mold control agents, mildew control agents, antiviral agents, anti-microbials, drying agents, stain resistance agents, soil release agents, malodor control agents, fabric refreshing agents, chlorine bleach odor control agents, dye fixatives, dye transfer inhibitors, color maintenance agents, color restoration/rejuvenation agents, anti-fading agents, whiteness enhancers, anti-abrasion agents, wear resistance agents, fabric integrity agents, antiwear agents, defoamers and anti-foaming agents, rinse aids, UV protection agents, sun fade inhibitors, insect repellents, anti-allergenic agents, enzymes, flame retardants, water proofing agents, fabric comfort agents, water conditioning agents, shrinkage resistance agents, stretch resistance agents, thickeners, chelants, electrolytes and mixtures thereof.

Deposition Aid—In one aspect, the fabric treatment composition may comprise from about 0.01% to about 10%, from about 0.05 to about 5%, or from about 0.15 to about 3% of a deposition aid. Suitable deposition aids are disclosed in, for example, U.S. patent application Ser. No. 12/080,358.

In one aspect, the deposition aid may be a cationic or amphoteric polymer. In one aspect, the deposition aid may be a cationic polymer. In one aspect, the cationic polymer may comprise a cationic acrylate such as Rheovis CDE™. Cationic polymers in general and their method of manufacture are known in the literature. In one aspect, the cationic polymer may have a cationic charge density of from about 0.005 to about 23, from about 0.01 to about 12, or from about 0.1 to about 7 milliequivalents/g, at the pH of intended use of the composition. For amine-containing polymers, wherein the charge density depends on the pH of the composition, charge density is measured at the intended use pH of the product. Such pH will generally range from about 2 to about 11, more generally from about 2.5 to about 9.5. Charge density is calculated by dividing the number of net charges per repeating unit by the molecular weight of the repeating unit. The positive charges may be located on the backbone of the polymers and/or the side chains of polymers.

One group of suitable cationic polymers includes those produced by polymerization of ethylenically unsaturated monomers using a suitable initiator or catalyst, such as those disclosed in U.S. Pat. No. 6,642,200.

Suitable polymers may be selected from the group consisting of cationic or amphoteric polysaccharide, polyethylene imine and its derivatives, and a synthetic polymer made by polymerizing one or more cationic monomers selected from the group consisting of N,N-dialkylaminoalkyl acrylate, N,N-dialkylaminoalkyl methacrylate, N,N-dialkylaminoalkyl acrylamide, N,N-dialkylaminoalkylmethacrylamide, quaternized N,N dialkylaminoalkyl acrylate quaternized N,N-dialkylaminoalkyl methacrylate, quaternized N,N-dialkylaminoalkyl acrylamide, quaternized N,N-dialkylaminoalkylmethacrylamide, Methacryloamidopropyl-pentamethyl-1,3-propylene-2-ol-ammonium dichloride, N,N,N,N',N',N",N"-heptamethyl-N"-3-(1-oxo-2-methyl-2-propenyl) aminopropyl-9-oxo-8-azo-decane-1,4,10-triammonium trichloride, vinylamine and its derivatives, allylamine and its derivatives, vinyl imidazole, quaternized vinyl imidazole and diallyl dialkyl ammonium chloride and combinations thereof, and optionally a second monomer selected from the group consisting of acrylamide, N,N-dialkyl acrylamide, methacrylamide, N,N-dialkylmethacrylamide, $C_1$-$C_{12}$ alkyl acrylate, $C_1$-$C_{12}$ hydroxyalkyl acrylate, polyalkylene glyol acrylate, $C_1$-$C_{12}$ alkyl methacrylate, $C_1$-$C_{12}$ hydroxyalkyl methacrylate, polyalkylene glycol methacrylate, vinyl acetate, vinyl alcohol, vinyl formamide, vinyl acetamide, vinyl alkyl ether, vinyl pyridine, vinyl pyrrolidone, vinyl imidazole, vinyl caprolactam, and derivatives, acrylic acid, methacrylic acid, maleic acid, vinyl sulfonic acid, styrene sulfonic acid, acrylamidopropylmethane sulfonic acid (AMPS) and their salts. The polymer may optionally be branched or cross-linked by using branching and crosslinking monomers. Branching and crosslinking monomers include ethylene glycoldiacrylate divinylbenzene, and butadiene. A suitable polyethyleneinine useful herein is that sold under the tradename Lupasol® by BASF, AG, Lugwigschaefen, Germany.

In another aspect, the treatment composition may comprise an amphoteric deposition aid polymer so long as the polymer possesses a net positive charge. Said polymer may have a cationic charge density of about 0.05 to about 18 milliequivalents/g.

In another aspect, the deposition aid may be selected from the group consisting of cationic polysaccharide, polyethylene imine and its derivatives, poly(acrylamide-co-diallyldimethylammonium chloride), poly(acrylamide-methacrylamidopropyltrimethyl ammonium chloride), poly(acrylamide-co-N,N-dimethyl aminoethyl acrylate) and its quaternized derivatives, poly(acrylamide-co-N,N-dimethyl aminoethyl methacrylate) and its quaternized derivative, poly(hydroxyethylacrylate-co-dimethyl aminoethyl methacrylate), poly (hydroxpropylacrylate-co-dimethyl aminoethyl methacrylate), poly(hydroxpropylacrylate-co-methacrylamidopropyltrimethylammonium chloride), poly (acrylamide-co-diallyldimethylammonium chloride-co-acrylic acid), poly(acrylamide-methacrylamidopropyltrimethyl ammonium chloride-co-acrylic acid), poly(diallyldimethyl ammonium chloride), poly(vinylpyrrolidone-co-dimethylaminoethyl methacrylate), poly(ethyl methacrylate-co-quaternized dimethylaminoethyl methacrylate), poly(ethyl methacrylate-co-oleyl methacrylate-co-diethylaminoethyl methacrylate), poly(diallyldimethylammonium chloride-co-acrylic acid), poly(vinyl pyrrolidone-co-quaternized vinyl imidazole) and poly (acrylamide-co-Methacryloamidopropyl-pentamethyl-1,3-propylene-2-ol-ammonium dichloride), Suitable deposition aids include Polyquaternium-1, Polyquaternium-5, Polyquaternium-6, Polyquaternium-7, Polyquaternium-8, Polyquaternium-11, Polyquaternium-14, Polyquaternium-22, Polyquaternium-28, Polyquaternium-30, Polyquaternium-32 and Polyquaternium-33, as named under the International Nomenclature for Cosmetic Ingredients.

In one aspect, the deposition aid may comprise polyethyleneimine or a polyethyleneimine derivative. In another aspect, the deposition aid may comprise a cationic acrylic based polymer. In a further aspect, the deposition aid may comprise a cationic polyacrylamide. In another aspect, the deposition aid may comprise a polymer comprising polyacrylamide and polymethacrylamidoproply trimethylammonium cation. In another aspect, the deposition aid may comprise poly(acrylamide-N-dimethyl aminoethyl acrylate) and its quaternized derivatives. In this aspect, the deposition aid may be that sold under the tradename Sedipur®, available from BTC Specialty Chemicals, a BASF Group, Florham Park, N.J. In a yet further aspect, the deposition aid may comprise poly(acrylamide-co-methacrylamidopropyltrimethyl ammonium chloride). In another aspect, the deposition aid may comprise a non-acrylamide based polymer, such as that sold under the tradename Rheovis® CDE, available from Ciba Specialty Chemicals, a BASF group, Florham Park, N.J., or as disclosed in USPA 2006/0252668.

In another aspect, the deposition aid may be selected from the group consisting of cationic or amphoteric polysaccharides. In one aspect, the deposition aid may be selected from the group consisting of cationic and amphoteric cellulose ethers, cationic or amphoteric galactomanan, cationic guar gum, cationic or amphoteric starch, and combinations thereof.

Another group of suitable cationic polymers may include alkylamine-epichlorohydrin polymers which are reaction products of amines and oligoamines with epicholorohydrin, for example, those polymers listed in, for example, U.S. Pat. Nos. 6,642,200 and 6,551,986. Examples include dimethylamine-epichlorohydrin-ethylenediamine, available under the trade name Cartafix® CB and Cartafix® TSF from Clariant, Basle, Switzerland.

Another group of suitable synthetic cationic polymers may include polyamidoamine-epichlorohydrin (PAE) resins of polyalkylenepolyamine with polycarboxylic acid. The most common PAE resins are the condensation products of diethylenetriamine with adipic acid followed by a subsequent reaction with epichlorohydrin. They are available from Hercules Inc. of Wilmington Del. under the trade name Kymene™ or from BASF AG (Ludwigshafen, Germany) under the trade name Luresin™.

The cationic polymers may contain charge neutralizing anions such that the overall polymer is neutral under ambient conditions. Non-limiting examples of suitable counter ions (in addition to anionic species generated during use) include chloride, bromide, sulfate, methylsulfate, sulfonate, methylsulfonate, carbonate, bicarbonate, formate, acetate, citrate, nitrate, and mixtures thereof.

The weight-average molecular weight of the polymer may be from about 500 to about 5,000,000, or from about 1,000 to about 2,000,000, or from about 2,500 to about 1,500,000 Daltons, as determined by size exclusion chromatography relative to polyethyleneoxide standards with RI detection. In one aspect, the MW of the cationic polymer may be from about 500 to about 37,500 Daltons.

Perfume Delivery Technologies

The fluid fabric enhancer compositions may comprise one or more perfume delivery technologies that stabilize and enhance the deposition and release of perfume ingredients from treated substrate. Such perfume delivery technologies can also be used to increase the longevity of perfume release from the treated substrate. Perfume delivery technologies, methods of making certain perfume delivery technologies and the uses of such perfume delivery technologies are disclosed in US 2007/0275866 A1, US 2004/0110648 A1, US 2004/0092414 A1, 2004/0091445 A1, 2004/0087476 A1, U.S. Pat. Nos. 6,531,444, 6,024,943, 6,042,792, 6,051,540, 4,540,721, and 4,973,422.

In one aspect, the fluid fabric enhancer composition may comprise from about 0.001% to about 20%, or from about 0.01% to about 10%, or from about 0.05% to about 5%, or even from about 0.1% to about 0.5% by weight of the perfume delivery technology. In one aspect, said perfume delivery technologies may be selected from the group consisting of: perfume microcapsules, pro-perfumes, polymer particles, functionalized silicones, polymer assisted delivery, molecule assisted delivery, fiber assisted delivery, amine assisted delivery, cyclodextrins, starch encapsulated accord, zeolite and inorganic carrier, and mixtures thereof:

Perfume Microcapsules:

In one aspect, said perfume delivery technology may comprise perfume microcapsules formed by at least partially surrounding the perfume raw materials with a wall material. In one aspect, the microcapsule wall material may comprise: melamine, polyacrylamide, silicones, silica, polystyrene, polyurea, polyurethanes, polyacrylate based materials, gelatin, polyamides, and mixtures thereof. In one aspect, said melamine wall material may comprise melamine crosslinked with formaldehyde, melamine-dimethoxyethanol crosslinked with formaldehyde, and mixtures thereof. In one aspect, said polystyrene wall material may comprise polyestyrene cross-linked with divinylbenzene. In one aspect, said polyurea wall material may comprise urea crosslinked with formaldehyde, urea crosslinked with gluteraldehyde, and mixtures thereof. In one aspect, said polyacrylate based materials may comprise polyacrylate formed from methylmethacrylate/dimethylaminomethyl methacrylate, polyacrylate formed from amine acrylate and/or methacrylate and strong acid, polyacrylate formed from carboxylic acid acrylate and/or methacrylate monomer and strong base, polyacrylate formed from an amine acrylate and/or methacrylate monomer and a carboxylic acid acrylate and/or carboxylic acid methacrylate monomer, and mixtures thereof. In one aspect, the perfume microcapsule may be coated with a deposition aid, a cationic polymer, a non-ionic polymer, an anionic polymer, or mixtures thereof. Suitable polymers may be selected from the group consisting of: polyvinylformaldehyde, partially hydroxylated polyvinylformaldehyde, polyvinylamine, polyethyleneimine, ethoxylated polyethyleneimine, polyvinylalcohol, polyacrylates, and combinations thereof. Suitable deposition aids are described above and in the section titled "Deposition Aid".

Amine Reaction Product (ARP): For purposes of the present application, ARP is a subclass or species of PP. One may also use "reactive" polymeric amines in which the amine functionality is pre-reacted with one or more PRMs to form an amine reaction product (ARP). Typically the reactive amines are primary and/or secondary amines, and may be part of a polymer or a monomer (non-polymer). Such ARPs may also be mixed with additional PRMs to provide benefits of polymer-assisted delivery and/or amine-assisted delivery. Nonlimiting examples of polymeric amines include polymers based on polyalkylimines, such as polyethyleneimine (PEI), or polyvinylamine (PVAm). Nonlimiting examples of monomeric (non-polymeric) amines include hydroxylamines, such as 2-aminoethanol and its alkyl substituted derivatives, and aromatic amines such as anthranilates. The ARPs may be premixed with perfume or added separately in leave-on or rinse-off applications. In another aspect, a material that contains a heteroatom other than nitrogen, for example oxygen, sulfur, phosphorus or selenium, may be used as an alternative to amine compounds. In yet another aspect, the aforementioned alternative compounds can be used in combination with amine compounds. In yet another aspect, a single molecule may comprise an amine moiety and one or more of the alternative heteroatom moieties, for example, thiols, phosphines and selenols. The benefit may include improved delivery of perfume as well as controlled perfume release. Suitable ARPs as well as methods of making same can be found in USPA 2005/0003980 A1 and U.S. Pat. No. 6,413,920 B1.

Process of Making:

A process for making a fluid fabric enhancer composition, said process comprising the steps of:

a) combining the structurant premix with a dispersion, said dispersion may comprise a fabric softener active and optionally an additional active to form a fluid fabric enhancer composition;

b) optionally, adjusting the pH of said fluid fabric enhancer composition such that the fluid fabric enhancer composition is at a pH at which the pH tuneable di-amido gellant is in its nonionic, viscosity building, form.

In one aspect of said process, said structurant premix may be maintained at a temperature of less than about 50° C., or even of less than about 30° C., and said process may comprise a fabric softener active feed that may be maintained at a temperature of less than about 50° C., or even at less than about 30° C.

In one aspect, the composition of the present invention can be prepared by a process comprising the steps of;

a) mixing and heating of the fabric softener active and/or other additives to form a melt;

b) dispensing the melt in water;

c) cooling the resulting dispersion to below the Krafft temperature of the softener active before adding other additives such as, non-ionic alkoxylated surfactants, polyols and silicone emulsion and/or other ingredients, wherein the Krafft temperature (or critical micelle temperature), is the minimum temperature at which the fabric softener active forms vesicles/micelles;

d) preparing a structurant premix comprising the pH tuneable di-amido gellant, wherein the structurant premix is at a pH such that the pH tuneable di-amido gellant is in its ionic, non-viscosity building, form;

e) combining the structurant premix with a dispersion, said dispersion comprising the fabric softener active and/or other additives;

f) adjusting the pH of the combined fluid detergent composition as needed, such that the fluid detergent composition is at a pH at which the pH tuneable amido gellant is in its nonionic, viscosity building, form.

In one aspect, the fluid fabric enhancer compositions comprising a pH tuneable di-amido gellant may be processed such that the temperatures of the structurant premix and/or the ingredient stream are maintained below the Krafft temperature.

Test Methods:

1. Minimum Gelling Concentration (MGC)

MGC is calculated by a tube inversion method based on R. G. Weiss, P. Terech; "Molecular Gels: Materials with self-assembled fibrillar structures" 2006 springer, p 243. In order to determine the MGC, three screenings are done:

a) First screening: prepare several vials increasing the pH tuneable di-amido gellant concentration from 0.5% to 5.0 weight % in 0.5% steps, at the target pH.

b) Determine in which interval the gel is formed (one inverted sample still flowing and the next one is already a strong gel). In case no gel is formed at 5%, higher concentrations are used.

c) Second screening: prepare several vials increasing the pH tuneable di-amido gellant concentration in 0.1 weight % steps in the interval determined in the first screening, at the target pH.

d) Determine in which interval the gel is formed (one inverted sample still flowing and the next one is already a strong gel)

e) Third screening: in order to have a very precise percentage of the MGC, run a third screening in 0.025 weight % steps in the interval determined in the second screening, at the target pH.

f) The Minimum Gelling Concentration (MGC) is the lowest concentration which forms a gel in the third screening (does not flow on inversion of the sample).

For each screening, samples are prepared and treated as follows: 8 mL vials (Borosilacate glass with Teflon cap, ref. B7857D, Fisher Scientific Bioblock) are filled with 2.0000±0.0005 g (KERN ALJ 120-4 analytical balance with ±0.1 mg precision) of demineralized water and/or solvent for which we want to determine the MGC. The vial is sealed with the screw cap and left for 10 minutes in an ultrasound bath (Elma Transsonic T 710 DH, 40 kHz, 9.5 L, at 25° C. and operating at 100% power) in order to disperse the solid in the liquid. Complete dissolution is then achieved by heating, using a heating gun (Bosch PHG-2), and gentle mechanical stifling of the vials. It is crucial to observe a completely clear solution. Handle vials with enhancer. While they are manufactured to resist high temperatures, a high solvent pressure may cause the vials to explode. Vials are cooled to 25° C., for 10 min in a thermostatic bath (Compatible Control Thermostats with controller CC2, D77656, Huber). Vials are inverted, left inverted for 1 minute, and then observed for which samples do not flow. After the third screening, the concentration of the sample that does not flow after this time is the MGC. For those skilled in the art, it is obvious that during heating solvent vapours may be formed, and upon cooling down the samples, these vapours can condense on top of the gel. When the vial is inverted, this condensed vapour will flow. This is discounted during the observation period. If no gels are obtained in the concentration interval, higher concentrations must be evaluated.

2. Dispenser Residue Test

The dispenser residue test is to visualize the amount of fluid fabric enhancer residue left by either dilute or concentrate fluid fabric enhancer, in a washing machine fabric enhancer dispenser after a full washing machine run. A series of 10 cumulative washes is done in the same washing machine without cleaning out the dispenser in between cycles. Before the first cycle, the washing machine fabric enhancer dispenser needs to be cleaned, removing any residue with hot water and drying the dispenser with a wipe. In between cycles the dispenser must not be cleaned. This test is performed in a Bauknecht Wash. 9850. In first place, the washing machine is loaded with ±2.65 Kg cotton ballast load, comprising 4 pillow cases, 4 tea towels, 800 grams of Muslin and 800 grams of Knitted cotton, previously pre-conditioned 4 times at 95° C. Add 150 grams of a powder detergent into the main wash detergent dispenser and 35 grams of a concentrated fabric softener (as the compositions described below) or 120 grams of a diluted fabric softener into the fabric conditioner dispenser. Start the wash cycle at 95° C., without pre-wash. Within one hour after the washing machine finishes, the residues on the dispenser are visually graded. Grading is done after 1, 5 and 10 cycles.

Grading of the Residues:

Grade 0: No residues

Grade 1: Maximum of 3 small spread spots of about 10 mm diameter each

Grade 2: From 4 to 7 small spots of 10 mm diameter each

Grade 3: Maximum of 3 spots of about 0.5 cm each

Grade 4: From 4 to 7 small spots of 0.5 cm diameter each)

Grade 5: Thick residue with diameter from about 1 to about 3 cm diameter (more or less half of the fabric softener dispenser)

Grade 6: Thick residue with diameter from about 3 to about 6 cm diameter (more or less three quarters of the fabric softener dispenser)

Grade 7: Thick residue with diameter from about 6 to about 8 cm diameter (more or less the whole fabric softener dispenser)

Grading from about 0 to about 3 is considered acceptable.

3. Method of Measuring the Solubility of Water-Soluble Films 5.0 grams±0.1 gram of the water-soluble film is added in a pre-weighed 400 ml beaker and 245 ml±1 ml of distilled water at 10° C. is added. This is stirred vigorously on a magnetic stirrer set at 600 rpm, for 30 minutes. Then, the mixture is filtered through a sintered-glass filter with a pore size of maximum 20 microns. The water is dried off from the collected filtrate by any conventional method, and the weight of the remaining material is determined (which is the dissolved or dispersed fraction). Then, the percentage solubility or dispersibility can be calculated.

4. Method of Measuring the Dissolution Time of Water-Soluble Films

The film is cut and mounted into a folding frame slide mount for 24 mm by 36 mm diapositive film, without glass (part number 94.000.07, supplied by Else, The Netherlands, however plastic folding frames from other suppliers may be used).

A standard 600 ml glass beaker is filled with 500 ml of city water at 10° C. and agitated using a magnetic stirring rod such that the bottom of the vortex is at the height of the 400 ml graduation mark on the beaker.

The slide mount is clipped to a vertical bar and suspended into the water, with the 36 mm side horizontal, along the diameter of the beaker, such that the edge of the slide mount is 5 mm from the beaker side, and the top of the slide mount is at the height of the 400 ml graduation mark. The stop watch is started immediately the slide mount is placed in the water, and stopped when the film fully dissolves. This time is recorded as the "film dissolution time".

EXAMPLES

Fluid Fabric Enhancer Comprising Di-amido Gellant

Non-limiting examples of product formulations containing di-amido gellants are summarized in the following table.

| | EXAMPLES | | | | | | | | | |
|---|---|---|---|---|---|---|---|---|---|---|
| % wt | A | B | C | D | E | F | G | H | I | J |
| FSA[a] | 14 | 16.47 | 14 | 12 | 12 | 16.47 | | | 5 | 5 |
| FSA[b] | | | | | | | 3.00 | | | |
| FSA[c] | | | | | | | | 6.5 | | |
| Ethanol | 2.18 | 2.57 | 2.18 | 1.95 | 1.95 | 2.57 | | | 0.81 | 0.81 |
| Isopropyl Alcohol | | | | | | | 0.33 | 1.22 | | |
| Starch[d] | 1.25 | 1.47 | 2.00 | 1.25 | | 2.30 | 0.5 | 0.70 | 0.71 | 0.42 |
| Perfume microcapsule | | 0.75 | 0.6 | 0.75 | 0.37 | 0.60 | 0.37 | 0.6 | 0.37 | 0.37 |
| Phase Stabilizing Polymer[f] | 0.21 | 0.25 | 0.21 | 0.21 | 0.14 | | | 0.14 | | |
| Suds Suppressor[g] | | | | | | | | 0.1 | | |
| Calcium Chloride | 0.15 | 0.176 | 0.15 | 0.15 | 0.30 | 0.176 | | 0.1-0.15 | | |
| DTPA[h] | 0.017 | 0.017 | 0.017 | 0.017 | 0.007 | 0.007 | 0.20 | | 0.002 | 0.002 |
| Preservative (ppm)[i,j] | 5 | 5 | 5 | 5 | 5 | 5 | | 250[j] | 5 | 5 |
| Antifoam[k] | 0.015 | 0.018 | 0.015 | 0.015 | 0.015 | 0.015 | | | 0.015 | 0.015 |
| Dye (ppm) | 40 | 40 | 40 | 40 | 40 | 40 | 11 | 30-300 | 30 | 30 |
| Ammonium Chloride | 0.100 | 0.118 | 0.100 | 0.100 | 0.115 | 0.115 | | | | |
| HCl | 1 | 1 | 1 | 1 | 1 | 1 | 1 | 1 | 1 | 1 |
| Sodium hydroxide | 1 | 1 | 1 | 1 | 1 | 1 | 1 | 1 | 1 | 1 |
| (6S,19S)-6,19-diisopropyl-4,7,18,21-tetraoxo-5,8,17,20-tetraazatetracosane-1,24-dioic acid | 0.06 | 0.1 | 0.12 | 0.15 | 0.18 | 0.2 | 0.25 | | | |
| (6S,23S)-6,23-diisopropyl-4,7,22,25-tetraoxo-5,8,21,24-tetraazaoctacosane-1,28-dioic acid | 0.02 | | | | | | | 0.15 | 0.2 | 0.1 |
| Neat Unencapsulated Perfume | 0.8 | 0.7 | 0.9 | 0.5 | 1.2 | 0.5 | 1.1 | 0.6 | 1.0 | 0.9 |
| Deionized Water | Up to 100 | Up to 100 | Up to 100 | Up to 100 | Up to 100 | Up to 100 | Up to 100 | Up to 100 | Up to 100 | Up to 100 |

[a]N,N-di(tallowoyloxyethyl)-N,N-dimethylammonium chloride.

[b]Methyl bis(tallow amidoethyl)2-hydroxyethyl ammonium methyl sulfate.

[c]Reaction product of Fatty acid with Methyldiethanolamine in a molar ratio 1.5:1, quaternized with Methylchloride, resulting in a 1:1 molar mixture of N,N-bis(stearoyl-oxy-ethyl) N,N-dimethyl ammonium chloride and N-(stearoyl-oxy-ethyl) N,-hydroxyethyl N,N dimethyl ammonium chloride.

[d]Cationic high amylose maize starch available from National Starch under the trade name CATO ®.

[f]Copolymer of ethylene oxide and terephthalate having the formula described in U.S. Pat. No. 5,574,179 at col. 15, lines 1-5, wherein each X is methyl, each n is 40, u is 4, each R1 is essentially 1,4-phenylene moieties, each R2 is essentially ethylene, 1,2-propylene moieties, or mixtures thereof.

[g]SE39 from Wacker

[h]Diethylenetriaminepentaacetic acid.

[i]KATHON ® CG available from Rohm and Haas Co. "PPM" is "parts per million."

[j]Gluteraldehyde

[k]Silicone antifoam agent available from Dow Corning Corp. under the trade name DC2310.

[l]Hydrophobically-modified ethoxylated urethane available from Rohm and Haas under the tradename Aculyn ™ 44.

The fluid fabric enhancers provided in this example are tested in accordance with the residue test method described above and the results are:

| | A | B | C | D | E | F | G | H | I | J |
|---|---|---|---|---|---|---|---|---|---|---|
| Average 10 cycles | 0.2 | 0.2 | 0.5 | 0.7 | 1.3 | 1.7 | 1.8 | 0.2 | 2.3 | 1.0 |

Thus, it is clear that the use of a pH tuneable di-amido gellant to give a reach impression and to improve the stability of fluid fabric enhancer composition such as perfume microcapsules, unexpectedly leaves no residues in the washing machine dispenser.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A fluid fabric enhancer composition comprising:

a) a fabric softener active selected from the group consisting of:

(i) from about 0.5 wt % to about 30 wt % silicone;

(ii) cationic starch;

(iii) a quaternized material comprising fatty acid moieties, said quaternized material having an average chain length of the fatty acid moieties of from 16 to 18 carbon atoms;

(iv) a vegetable oil and/or a hydrocarbon based oil (v) a clay, said clay comprising a smectite clay;

(vi) a sucrose ester having Iodine Value of from about 1 to about 150;

(vii) a polyolefin selected from the group consisting of polyethylene, polypropylene, and mixtures thereof; and/or (viii) a polymer latex having a glass transition temperature of from about −120° C. to about 120° C.; and (ix) mixtures thereof;

b) from about 0.01 wt % to about 5 wt % of a pH tuneable di-amido gellant having following formula:

[I]

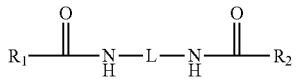

wherein $R_1$ and $R_2$ are aminofunctional end-groups; L is a backbone moiety having molecular weight from about 14 g/mol to about 500 g/mol; and at least one of L, $R_1$ or $R_2$ comprises a pH-sensitive group selected from the group consisting of

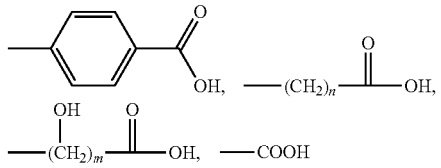

wherein the indices n and m are integers from 1 to 20 and the ring aromatic ring moiety of the pH-sensitive group

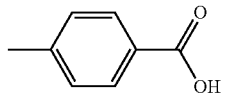

is optionally substituted at one or more of positions 2, 3, 5 and/or 6 said pH tuneable di-amido-gellant having a pKa of from about 0 to about 30.

2. The fluid fabric enhancer composition of claim 1, wherein the pH tuneable di-amido gellant has a pKa of from about 1.5 to about 14.

3. A fluid fabric enhancer composition according to claim 1, wherein the pH tuneable di-amido gellant has a molecular weight from about 150 to about 1500 g/mol.

4. A fluid fabric enhancer composition according to claim 1, wherein the pH tuneable di-amido gellant has a minimum gelling concentration (MGC) of from about 0.1 to about 50 mg/mL, in water, at the target pH of the fluid fabric enhancer composition.

5. A fluid fabric enhancer composition according to claim 1, wherein the pH tuneable di-amido gellant is selected from the group consisting of (6S,13S)-6,13-diisopropyl-4,7,12,15-tetraoxo-5,8,11,14-tetraazaoctadecane-1,18-dioic acid, (6S,14S')-6,14-diisopropyl-4,7,13,16-tetraoxo-5,8,12,15-tetraazanonadecane-1,19-dioic acid, (6S,15S)-6,15-diisopropyl-4,7,14,17-tetraoxo-5,8,13,16-tetraazaeicosane-1,20-dioic acid, (6S,16S)-6,16-diisopropyl-4,7,15,18-tetraoxo-5,8,14,17-tetraazaheneicosane-1,21-dioic acid, (6S,17S)-6,17-diisopropyl-4,7,16,19-tetraoxo-5,8,15,18-tetraazadocosane-1,22-dioic acid, (6S,18S)-6,18-diisopropyl-4,7,17,20-tetraoxo-5,8,16,19-tetraazatricosane-1,23-dioic acid, (6S,19S)-6,19-diisopropyl-4,7,18,21-tetraoxo-5,8,17,20-tetraazatetracosane-1,24-dioic acid, (6S,20S)-6,20-diisopropyl-4,7,19,22-tetraoxo-5,8,18,21-tetraazapentacosane-1,25-dioic acid, (6S,21S)-6,21-diisopropyl-4,7,20,23-tetraoxo-5,8,19,22-tetraazahexacosane-1,26-dioic acid, (6S,22S)-6,22-diisopropyl-4,7,21,24-tetraoxo-5,8,20,23-tetraazaheptacosane-1,27-dioic acid, (6S,23S)-6,23-diisopropyl-4,7,22,25-tetraoxo-5,8,21,24-tetraazaoctacosane-1,28-dioic acid, 4-[[(1S)-1-[2-[[(2S)-2-[(4-hydroxy-4-oxo-butanoyl)amino]-3-methyl-pentanoyl]amino]ethylcarbamoyl]-2-methyl-butyl]amino]-4-oxo-butanoic acid, 4-[[(1S)-1-[3-[[(2S)-2-[(4-hydroxy-4-oxo-butanoyl)amino]-3-methyl-pentanoyl]amino]propylcarbamoyl]-2-methyl-butyl]amino]-4-oxo-butanoic acid, 4-[[(1S)-1-[4-[[(2S)-2-[(4-hydroxy-4-oxo-butanoyl)amino]-3-methyl-pentanoyl]amino]butylcarbamoyl]-2-methyl-butyl]amino]-4-oxo-butanoic acid, 4-[[(1S)-1-[5-[[(2S)-2-[(4-hydroxy-4-oxo-butanoyl)amino]-3-methyl-pentanoyl]amino]pentylcarbamoyl]-2-methyl-butyl]amino]-4-oxo-butanoic acid, 4-[[(1S)-1-[6-[[(2S)-2-[(4-hydroxy-4-oxo-butanoyl)amino]-3-methyl-pentanoyl]amino]hexylcarbamoyl]-2-methyl-butyl]amino]-4-oxo-butanoic acid, 4-[[(1S)-1-[7-[[(2S)-2-[(4-hydroxy-4-oxo-butanoyl)amino]-3-methyl-pentanoyl]amino]heptylcarbamoyl]-2-methyl-butyl]amino]-4-oxo-butanoic acid, 4-[[(1S)-1-[8-[[(2S)-2-[(4-hydroxy-4-oxo-butanoyl)amino]-3-methyl-pentanoyl]amino]octylcarbamoyl]-2-methyl-butyl]amino]-4-oxo-butanoic acid, 4-[[(1S)-1-[9-[[(2S)-2-[(4-hydroxy-4-oxo-butanoyl)amino]-3-methyl-pentanoyl]amino]nonylcarbamoyl]-2-methyl-butyl]amino]-4-oxo-butanoic acid, 4-[[(1S)-1-[10-[[(2S)-2-[(4-hydroxy-4-oxo-butanoyl)amino]-3-methyl-pentanoyl]amino]decylcarbamoyl]-2-methyl-butyl]amino]-4-oxo-butanoic acid, 4-[[(1S)-1-[11-[[(2S)-2-[(4-hydroxy-4-oxo-butanoyl)amino]-3-methyl-pentanoyl]amino]undecylcarbamoyl]-2-methyl-butyl]amino]-4-oxo-butanoic acid, 4-[[(1S)-1-[12-[[(2S)-2-[(4-hydroxy-4-oxo-butanoyl)amino]-3-methyl-pentanoyl]amino]dodecylcarbamoyl]-2-methyl-butyl]amino]-4-oxo-butanoic acid, 4-[[(1S)-1-benzyl-2-[2-[[(2S)-2-[(4-hydroxy-4-oxo-butanoyl)amino]-3-phenyl-propanoyl]amino]ethylamino]-2-oxo-ethyl]amino]-4-oxo-butanoic acid, 4-[[(1S)-1-benzyl-2-[3-[[(2S)-2-[(4-hydroxy-4-oxo-butanoyl)amino]-3-phenyl-propanoyl]amino]propylamino]-2-oxo-ethyl]amino]-4-oxo-butanoic acid, 4-[[(1S)-1-benzyl-2-[4-[[(2S)-2-[(4-hydroxy-4-oxo-butanoyl)amino]-3-phenyl-propanoyl]amino]butylamino]-2-oxo-ethyl]amino]-4-oxo-butanoic acid, 4-[[(1S)-1-benzyl-2-[5-[[(2S)-2-[(4-hydroxy-4-oxo-butanoyl)amino]-3-phenyl-propanoyl]amino]pentylamino]-2-oxo-ethyl]amino]-4-oxo-butanoic acid, 4-[[(1S)-1-benzyl-2-[6-[[(2S)-2-[(4-hydroxy-4-oxo-butanoyl)amino]-3-phenyl-propanoyl]amino]hexylamino]-2-oxo-ethyl]amino]-4-oxo-butanoic acid, 4-[[(1S)-1-benzyl-2-[7-[[(2S)-2-[(4-hydroxy-4-oxo-butanoyl)amino]-3-phenyl-propanoyl]amino]heptylamino]-2-oxo-ethyl]amino]-4-oxo-butanoic acid, 4-[[(1S)-1-benzyl-2-[8-[[(2S)-2-[(4-hydroxy-4-oxo-butanoyl)amino]-3-phenyl-propanoyl]amino]octylamino]-2-oxo-ethyl]amino]-4-oxo-butanoic acid, 4-[[(1S)-1-benzyl-2-[9-[[(2S)-2-[(4-hydroxy-4-oxo-butanoyl)amino]-3-phenyl-propanoyl]amino]nonylamino]-2-oxo-ethyl]amino]-4-oxo-butanoic acid, 4-[[(1S)-1-benzyl-2-[10-[[(2S)-2-[(4-hydroxy-4-oxo-butanoyl)amino]-3-phenyl-propanoyl]amino]decylamino]-2-oxo-ethyl]amino]-4-oxo-butanoic acid, 4-[[(1S)-1-benzyl-2-[11-[[(2S)-2-[(4-hydroxy-4-oxo-butanoyl)amino]-3-phenyl-propanoyl]amino]undecylamino]-2-oxo-ethyl]amino]-4-oxo-butanoic acid, 4-[[(1S)-1-benzyl-2-[12-[[(2S)-2-[(4-hydroxy-4-oxo-butanoyl)amino]-3-phenyl-propanoyl]amino]dodecylamino]-2-oxo-ethyl]amino]-4-oxo -butanoic acid, 4-[2-[[(1S)-1-[2-[[(2S)-2-[[2-(4-carboxyphenyl)acetyl]amino]-3-methyl-pentanoyl]amino]ethylcarbamoyl]-2-methyl-butyl]amino]-2-oxo-ethyl]benzoic acid, 4-[2-[[(1S)-1-[3-[[(2S)-2-[[2-(4-carboxyphenyl)acetyl]amino]-3-methyl-pentanoyl]amino]propylcarbamoyl]-2-methyl-butyl]amino]-2-oxo-ethyl]benzoic acid, 4-[2-[[(1S)-1-[4-[[(2S)-2-[[2-(4-carboxyphenyl)acetyl]amino]-3-methyl-pentanoyl]amino]butylcarbamoyl]-2-methyl-butyl]amino]-2-oxo-ethyl]benzoic acid, 4-[2-[[(1S)-1-[5-[[(2S)-2-[[2-(4-carboxyphenyl)acetyl]amino]-3-methyl-pentanoyl]amino]pentylcarbamoyl]-2-methyl-butyl]amino]-2-oxo-ethyl]benzoic acid, 4-[2-[[(1S)-1-[6-[[(2S)-2-[[2-(4-carboxyphenyl)acetyl]amino]-3-methyl-pentanoyl]amino]hexylcarbamoyl]-2-methyl-butyl]amino]-2-oxo-ethyl]benzoic acid, 4-[2-[[(1S)-1-[7-[[(2S)-2-[[2-(4-carboxyphenyl)acetyl]amino]-3-methyl-pentanoyl]amino]heptylcarbamoyl]-2-methyl-butyl]amino]-2-oxo-ethyl]benzoic acid, -[2-[[(1S)-1-[8-[[(2S)-2-[[2-(4-carboxyphenyl)acetyl]amino]-3-methyl-pentanoyl]amino]octylcarbamoyl]-2-methyl-butyl]amino]-2-oxo-ethyl]benzoic acid, 4-[2-[[(1S)-1-[9-[[(2S)-2-[[2-(4-carboxyphenyl)acetyl]amino]-3-methyl-pentanoyl]amino]nonylcarbamoyl]-2-methyl-butyl]amino]-2-oxo-ethyl]benzoic acid, 4-[2-[[(1S)-1-[10-[[(2S)-2-[[2-(4-carboxyphenyl)acetyl]amino]-3-methyl-pentanoyl]amino]decylcarbamoyl]-2-methyl-butyl]amino]-2-oxo-ethyl]benzoic acid, 4-[2-[[(1S)-1-[11-[[(2S)-2-[[2-(4-carboxyphenyl)acetyl]amino]-3-methyl-pentanoyl]amino]undecylcarbamoyl]-2-methyl-butyl]amino]-2-oxo-ethyl]benzoic acid, 4-[2-[[(1S)-1-[12-[[(2S)-2-[[2-(4-carboxyphenyl)acetyl]amino]-3-methyl-pentanoyl]amino]dodecylcarbamoyl]-2-methyl-butyl]amino]-2-oxo-ethyl]benzoic acid, and mixtures thereof.

6. A fluid fabric enhancer composition according to claim 1, wherein the pH tuneable di-amido gellant is selected from the group consisting of (6S,18S)-6,18-diisopropyl-4,7,17,20-tetraoxo-5,8,16,19-tetraazatricosane-1,23-dioic acid, (6S,19S)-6,19-diisopropyl-4,7,18,21-tetraoxo-5,8,17,20-tetraazatetracosane-1,24-dioic acid, (6S,20S)-6,20-diisopropyl-4,7,19,22-tetraoxo-5,8,18,21-tetraazapentacosane-1,25-dioic acid, (6S,21S)-6,21-diisopropyl-4,7,20,23-tetraoxo-5,8,19,22-tetraazahexacosane-1,26-dioic acid, (6S,22S)-6,22-diisopropyl-4,7,21,24-tetraoxo-5,8,20,23-tetraazaheptacosane-1,27-dioic acid, (6S,23S)-6,23-diisopropyl-4,7,22,25-tetraoxo-5,8,21,24-tetraazaoctacosane-1,28-dioic acid, 4-[[(1S)-1-[6-[[(2S)-2-[(4-hydroxy-4-oxo-butanoyl)amino]-3-methyl-pentanoyl]amino]hexylcarbamoyl]-2-methyl-butyl]amino]-4-oxo-butanoic acid, 4-[[(1S)-1-[7-[[(2S)-2-[(4-hydroxy-4-oxo-butanoyl)amino]-3-methyl-pentanoyl]amino]heptylcarbamoyl]-2-methyl-butyl]amino]-4-oxo-butanoic acid, 4-[[(1S)-1-[8-[[(2S)-2-[(4-hydroxy-4-oxo-butanoyl)amino]-3-methyl-pentanoyl]amino]octylcarbamoyl]-2-methyl-butyl]amino]-4-oxo-butanoic acid, 4-[[(1S)-1-[9-[[(2S)-2-[(4-hydroxy-4-oxo-butanoyl)amino]-3-methyl-pentanoyl]amino]nonylcarbamoyl]-2-methyl-butyl]amino]-4-oxo-butanoic acid, 4-[[(1S)-1-[10-[[(2S)-2-[(4-hydroxy-4-oxo-butanoyl)amino]-3-methyl-pentanoyl]amino]decylcarbamoyl]-2-methyl-butyl]amino]-4-oxo-butanoic acid, 4-[[(1S)-1-[11-[[(2S)-2-[(4-hydroxy-4-oxo-butanoyl)amino]-3-methyl-pentanoyl]amino]undecylcarbamoyl]-2-methyl-butyl]amino]-4-oxo-butanoic acid, 4-[[(1S)-1-[12-[[(2S)-2-[(4-hydroxy-4-oxo-butanoyl)amino]-3-methyl-pentanoyl]amino]dodecylcarbamoyl]-2-methyl-butyl]amino]-4-oxo-butanoic acid, 4-[[(1S)-1-benzyl-2-[6-[[(2S)-2-[(4-hydroxy-4-oxo-butanoyl)amino]-3-phenyl-propanoyl]amino]hexylamino]-2-oxo-ethyl]amino]-4-oxo-butanoic acid, 4-[[(1S)-1-benzyl-2-[7-[[(2S)-2-[(4-hydroxy-4-oxo-butanoyl)amino]-3-phenyl-propanoyl]amino]heptylamino]-2-oxo-ethyl]amino]-4-oxo-butanoic acid, 4-[[(1S)-1-benzyl-2-[8-[[(2S)-2-[(4-hydroxy-4-oxo-butanoyl)amino]-3-phenyl-propanoyl]amino]octylamino]-2-oxo-ethyl]amino]-

4-oxo-butanoic acid, 4-[[(1S)-1-benzyl-2-[9-[[(2S)-2-[(4-hydroxy-4-oxo-butanoyl)amino]-3-phenyl-propanoyl]amino]nonylamino]-2-oxo-ethyl]amino]-4-oxo-butanoic acid, 4-[[(1S)-1-benzyl-2-[10-[[(2S)-2-[(4-hydroxy-4-oxo-butanoyl)amino]-3-phenyl-propanoyl]amino]decylamino]-2-oxo-ethyl]amino]-4-oxo-butanoic acid, 4-[[(1S)-1-benzyl-2-[11-[[(2S)-2-[(4-hydroxy-4-oxo-butanoyl)amino]-3-phenyl-propanoyl]amino]undecylamino]-2-oxo-ethyl]amino]-4-oxo-butanoic acid, 4-[[(1S)-1-benzyl-2-[12-[[(2S)-2-[(4-hydroxy-4-oxo-butanoyl)amino]-3-phenyl-propanoyl]amino]dodecylamino]-2-oxo-ethyl]amino]-4-oxo-butanoic acid, 4-[2-[[(1S)-1-[6-[[(2S)-2-[[2-(4-carboxyphenyl)acetyl]amino]-3-methyl-pentanoyl]amino]hexylcarbamoyl]-2-methyl-butyl]amino]-2-oxo-ethyl]benzoic acid, 4-[2-[[(1S)-1-[7-[[(2S)-2-[[2-(4-carboxyphenyl)acetyl]amino]-3-methyl-pentanoyl]amino]heptylcarbamoyl]-2-methyl-butyl]amino]-2-oxo-ethyl]benzoic acid, -[2-[[(1S)-1-[8-[[(2S)-2-[[2-(4-carboxyphenyl)acetyl]amino]-3-methyl-pentanoyl]amino]octylcarbamoyl]-2-methyl-butyl]amino]-2-oxo-ethyl]benzoic acid, 4-[2-[[(1S)-1-[9-[[(2S)-2-[[2-(4-carboxyphenyl)acetyl]amino]-3-methyl-pentanoyl]amino]nonylcarbamoyl]-2-methyl-butyl]amino]-2-oxo-ethyl]benzoic acid, 4-[2-[[(1S)-1-[10-[[(2S)-2-[[2-(4-carboxyphenyl)acetyl]amino]-3-methyl-pentanoyl]amino]decylcarbamoyl]-2-methyl-butyl]amino]-2-oxo-ethyl]benzoic acid, 4-[2-[[(1S)-1-[11-[[(2S)-2-[[2-(4-carboxyphenyl)acetyl]amino]-3-methyl-pentanoyl]amino]undecylcarbamoyl]-2-methyl-butyl]amino]-2-oxo-ethyl]benzoic acid, 4-[2-[[(1S)-1-[12-[[(2S)-2-[[2-(4-carboxyphenyl)acetyl]amino]-3-methyl-pentanoyl]amino]dodecylcarbamoyl]-2-methyl-butyl]amino]-2-oxo-ethyl]benzoic acid, and mixtures thereof.

7. A fluid fabric enhancer composition according to claim 1, wherein the pH tuneable di-amido gellant is selected from the group consisting of (6S,20S)-6,20-diisopropyl-4,7,19,22-tetraoxo-5,8,18,21-tetraazapentacosane-1,25-dioic acid, (6S,23S)-6,23-diisopropyl-4,7,22,25-tetraoxo-5,8,21,24-tetraazaoctacosane-1,28-dioic acid, 4-[[(1S)-1-[8-[[(2S)-2-[(4-hydroxy-4-oxo-butanoyl)amino]-3-methyl-pentanoyl]amino]octylcarbamoyl]-2-methyl-butyl]amino]-4-oxo-butanoic acid, 4-[[(1S)-1-[12-[[(2S)-2-[(4-hydroxy-4-oxo-butanoyl)amino]-3-methyl-pentanoyl]amino]dodecylcarbamoyl]-2-methyl-butyl]amino]-4-oxo-butanoic acid, 4-[[(1S)-1-benzyl-2-[8-[[(2S)-2-[(4-hydroxy-4-oxo-butanoyl)amino]-3-phenyl-propanoyl]amino]octylamino]-2-oxo-ethyl]amino]-4-oxo-butanoic acid, 4-[[(1S)-1-benzyl-2-[12-[[(2S)-2-[(4-hydroxy-4-oxo-butanoyl)amino]-3-phenyl-propanoyl]amino]dodecylamino]-2-oxo-ethyl]amino]-4-oxo-butanoic acid, -[2-[[(1S)-1-[8-[[(2S)-2-[[2-(4-carboxyphenyl)acetyl]amino]-3-methyl-pentanoyl]amino]octylcarbamoyl]-2-methyl-butyl]amino]-2-oxo-ethyl]benzoic acid, 4-[2-[[(1S)-1-[12-[[(2S)-2-[[2-(4-carboxyphenyl)acetyl]amino]-3-methyl-pentanoyl]amino]dodecylcarbamoyl]-2-methyl-butyl]amino]-2-oxo-ethyl]benzoic acid, and mixtures thereof.

8. The fluid fabric enhancer composition according to claim 1, wherein the composition comprises an adjunct ingredient.

9. The fluid fabric enhancer composition according to claim 1, wherein the composition comprises from about 0.01% to about 10% of a neat perfume composition.

10. The fluid fabric enhancer composition according to claim 1, wherein the composition comprises one or more perfume delivery systems.

11. The fluid fabric enhancer composition according to claim 1, wherein the composition comprises a perfume microcapsule.

12. The fluid fabric enhancer composition according to claim 1, wherein the composition comprises a perfume microcapsule that comprises an aminoplast material, polyamide material and/or an acrylate material.

13. The fluid fabric enhancer composition according to claim 1, wherein the composition comprises a perfume microcapsule comprising a cationic, nonionic and/or anionic deposition aid.

14. The fluid fabric enhancer composition according to claim 13, wherein the perfume microcapsule comprises a cationic polymer.

15. A fluid fabric enhancer composition according to claim 1, wherein the composition is enclosed within a water soluble pouch material.

16. A fluid fabric enhancer composition according to claim 15, wherein the composition is enclosed within a water soluble pouch material comprising polyvinyl alcohols, polyvinyl alcohol copolymers and hydroxypropyl methyl cellulose (HPMC), and combinations thereof.

17. A process for making a fluid fabric enhancer composition according to claim 1. , comprising the steps of:

a) combining a structurant premix with a dispersion, said dispersion comprising a fabric softener active and optionally an additional active to form a fluid fabric enhancer composition;

b) optionally, adjusting the pH of said fluid fabric enhancer composition such that the fluid fabric enhancer composition is at a pH at which the pH tuneable di amido gellant is in its nonionic, viscosity building, form.

18. A process, according to claim 17, wherein the structurant premix is maintained at a temperature of less than about 50° C., and said process comprises a fabric softener active feed that is maintained at a temperature of less than about 50° C.

19. The fluid fabric enhancer composition of claim 1, wherein:

a) said silicone is selected from the group consisting of polydialkylsilicone, derivatives of polydialkylsilicone, polydimethyl silicone, derivatives of polydimethyl silicone, aminofunctional silicone, derivatives of aminofunctional silicone and mixtures thereof;

b) said a vegetable oil and/or a hydrocarbon based oil is selected from the group consisting of soybean oil, sunflower oil, canola oil, polyolefins, isoparaffins, cyclic paraffins, triolein and mixtures thereof;

c) said sucrose ester has an Iodine Value of from about 1 to about 100;

d) said polyethylene is a dispersible polyethylenes having particle size diameter range (X50) from about 1 nm to about 100 microns; and e) said polymer latex has a glass transition temperature of from about −80° C. to about 60° C.

20. The fluid fabric enhancer composition of claim 1, wherein:

a) said sucrose ester has an Iodine Value of from about 5 to about 85;

b) said polyethylene is a dispersible polyethylenes having a particle size diameter range (X50) from about 10 nm to about 10 microns; and c) said polymer latex comprises a dispersible polymer latex having particle size diameter range (X50) from about 1 nm to about 100 microns.

21. The fluid fabric enhancer composition of claim 20, wherein said dispersible polymer latex has particle size diameter range (X50) from about 10 nm to about 100 microns.

* * * * *